US009848700B2

(12) United States Patent
Corless

(10) Patent No.: US 9,848,700 B2
(45) Date of Patent: Dec. 26, 2017

(54) SLIDABLE KITCHEN ORGANIZER APPARATUS AND METHOD OF USE

(71) Applicant: Hardware Resources, Inc., Bossier City, LA (US)

(72) Inventor: Justin Corless, Dallas, TX (US)

(73) Assignee: Hardware Resources, Inc., Bossier City, LA (US)

( * ) Notice: Subject to any disclaimer, the term of this patent is extended or adjusted under 35 U.S.C. 154(b) by 0 days.

(21) Appl. No.: 15/249,170

(22) Filed: Aug. 26, 2016

(65) Prior Publication Data

US 2017/0055703 A1 Mar. 2, 2017

Related U.S. Application Data

(60) Provisional application No. 62/210,211, filed on Aug. 26, 2015.

(51) Int. Cl.

| | |
|---|---|
| ***A47B 88/40*** | (2017.01) |
| ***A47B 77/14*** | (2006.01) |
| ***A47B 96/00*** | (2006.01) |

(52) U.S. Cl.

CPC ..... *A47B 88/40* (2017.01); *A47B 77/14* (2013.01); *A47B 96/00* (2013.01)

(58) Field of Classification Search

CPC ..... A47B 77/14; A47B 88/40; A47B 88/42; A47B 88/421; A47B 96/00; A47B 96/067; A47L 15/50; A47L 15/507

USPC ..... 211/41.2

See application file for complete search history.

(56) References Cited

U.S. PATENT DOCUMENTS

| | | | | |
|---|---|---|---|---|
| 2,418,919 A * | 4/1947 | Benson | A47B 77/14 211/123 |
| 2,608,305 A * | 8/1952 | Sager | A47J 47/16 211/106 |
| 2,758,904 A | 8/1956 | Hansell et al. | |
| 3,037,733 A | 6/1962 | Roman | |
| 3,269,548 A * | 8/1966 | Geiger | A47L 15/50 134/165 |
| 3,379,484 A | 4/1968 | Kling | |

(Continued)

FOREIGN PATENT DOCUMENTS

| | | |
|---|---|---|
| DE | 19842666 | 4/2008 |
| JP | 06105723 | 4/1994 |

OTHER PUBLICATIONS

"Glideware Pull-out Cabinet Organizer for Pots and Pans," Amazon, amazon.com, seller: Glideware, accessed Jul. 2015. http://www.amazon.com/Glideware-Pull-out-Cabinet-Organizer-Pots/dp/B00GVHQWB2.

(Continued)

*Primary Examiner* — Ko Hung Chan

(74) *Attorney, Agent, or Firm* — Schultz & Associates, P.C.

(57) ABSTRACT

A slidable kitchen organizer apparatus comprised of a combination of "V" shaped wire baskets and "L" shaped wire baskets. Each basket includes an extruded aluminum slatwall and is individually mounted on sliding assemblies within separate portions of a cabinet carcass. Each slide assembly is capable of independently sliding from a stored position within the cabinet to a deployed position outside of the cabinet. Removable, adjustable, and interchangeable hooks and shelves can be attached to the slatwalls.

18 Claims, 20 Drawing Sheets

(56) References Cited

U.S. PATENT DOCUMENTS

| | | | | |
|---|---|---|---|---|
| 3,556,625 | A * | 1/1971 | Kauffman | A47L 15/507 312/301 |
| 4,141,525 | A | 2/1979 | Miller | |
| 6,164,467 | A | 12/2000 | DePottey et al. | |
| 6,199,966 | B1 * | 3/2001 | Fulterer | A47B 88/42 312/270.3 |
| 6,227,387 | B1 | 5/2001 | Rose | |
| 6,491,173 | B1 | 12/2002 | Costa | |
| 6,811,043 | B2 | 11/2004 | Perkins et al. | |
| 6,938,784 | B2 * | 9/2005 | Yang | A47B 88/00 211/87.01 |
| 6,976,595 | B1 | 12/2005 | Geller | |
| 7,104,409 | B2 | 9/2006 | Morgan | |
| 7,510,092 | B2 | 3/2009 | Sholem | |
| 9,022,237 | B2 | 5/2015 | Hall et al. | |
| 2004/0079713 | A1 * | 4/2004 | Wendt et al. | A47L 15/502 211/41.8 |
| 2006/0243681 | A1 * | 11/2006 | Bastuji et al. | A47L 15/502 211/41.8 |
| 2011/0000864 | A1 | 1/2011 | Moore | |
| 2012/0091086 | A1 * | 4/2012 | Gregory et al. | A47B 96/067 211/86.01 |
| 2012/0139402 | A1 * | 6/2012 | Haidar et al. | F25D 25/025 312/404 |
| 2012/0146476 | A1 * | 6/2012 | Tibbe | A47B 88/42 312/334.8 |
| 2012/0211449 | A1 | 8/2012 | Newbauer | |
| 2013/0088134 | A1 | 4/2013 | Varner et al. | |
| 2013/0099073 | A1 * | 4/2013 | Bradbury | A47B 77/14 248/200.1 |
| 2014/0197121 | A1 | 7/2014 | Knight et al. | |

OTHER PUBLICATIONS

"Knape & Vogt Pot & Pan Pantry Pull-Out Cabinet Organizer," Kitchen Source, kitchensource.com, accessed Jul. 2015. http://www.kitchensource.com/cabinet-organizers/kv-pan1700tm.htm.

"Knape & Vogt Slide-Out Pot and Pan Caddy for Kitchen Base Cabinet," Kitchen Source, kitchensource.com, accessed Jul. 2015. http://www.kitchensource.com/cabinet-organizers/kv-sps21-c.htm.

"Rev-A-Shelf Pair of Chrome Pull-Out Baskets for Your Kitchen Cabinet," Kitchen Source, kitchensource.com, accessed Jul. 2015. http://www.kitchensource.com/cabinet-organizers/rv-5wb2.htm.

* cited by examiner

SLIDABLE KITCHEN ORGANIZER APPARATUS AND METHOD OF USE

CROSS-REFERENCE TO RELATED APPLICATIONS

This application claims the benefit of U.S. Provisional Patent Application No. 62/210,211 filed on Aug. 26, 2015, the contents of which are incorporated herein by reference.

FIELD OF THE DISCLOSURE

This disclosure relates to kitchen equipment storage. In particular, the disclosure relates to a kitchen organizer mounted on sliding assemblies capable of independently sliding from a stored position within a cabinet to a deployed position outside of the cabinet.

BACKGROUND OF THE DISCLOSURE

Pots and pans and their respective lids are bulky and present a storage problem. Typically pots and pans are stacked/nested within each other in a drawer. As a result, the cooking surfaces may get scratched or otherwise damaged which not only compromises the cooking efficiency of the items but also affect their aesthetics. To access a particular pot, each nested pot on top of the desired pot would need to be removed individually until the desired pot is accessible. Then the remaining pots are required to be restacked and placed back in the drawer. Additionally, the lids to the pots and pans are typically stored separately and locating the correct sized lid for a chosen pot may be tedious and time consuming.

The prior art has addressed the storage of pots and pans unsuccessfully.

U.S. Pat. No. 2,758,904 to Hansell, et al. discloses a pan rack assembly comprised of a peg board wall member slidably deployable from within a cabinet. Pan hanger hooks are removably mounted in a plurality of regularly spaced apertures in the wall member. The wall member includes a "T" shaped rail on its top edge slidable within a channel member mounted to the upper inside of the cabinet. The bottom edge of the wall member rides in a wooden track or guide means mounted to the lower inside of the cabinet. The pans are hung on the hooks flush with the face of the peg board.

U.S. Pat. No. 2,608,305 to Sager discloses a pot and pan mounting apparatus comprised of a movable panel slidingly mounted within a cabinet. Various pins and racks are fixedly mounted to the movable panel for hanging pots, pans, and their lids. A handle stabilizer hook holds the pans against backward swinging during deployment of the movable panel from the cabinet. The pins and racks are not adjustable and the pots and pans may still require nesting.

Therefore there is a need for a customizable kitchen organizer for storage of pots and pans and their respective lids such that each pot or pan is individually accessible without the removal of any adjacent equipment. The organizer will store the correct lid next to its matching pot or pan.

SUMMARY

The apparatus disclosed is a customizable kitchen organizer comprised of one or more a "V" shaped wire baskets and one or more "L" shaped wire baskets. Each basket includes an extruded slatwall mounted to a frame. Each frame is individually mounted on slide assemblies within separate portions of a cabinet carcass. Each slide assembly is capable of independently sliding from a stored position within the cabinet to a deployed position outside of the cabinet. Removable, adjustable, and interchangeable hooks and shelves can be attached to the slatwalls for the hanging of pots and pans. The baskets are sized to hold the corresponding lids and/or oversized pots.

In use, common kitchen utensils such as pots and pans and their respective lids can be conveniently stored in the organizer. The pots and pans hang on the hooks or are supported by the shelves. The hooks and shelves are removably rearranged on the slatwall in order to accommodate different applications. The hooks include pins that engage the handles of the pots and pans to prevent the swinging of the items during the deployment of the sliding assemblies from the cabinet.

BRIEF DESCRIPTION OF THE DRAWINGS

Reference will now be made to the drawings, wherein like parts are designated by like numerals, and wherein.

DETAILED DESCRIPTION

Figure 1:
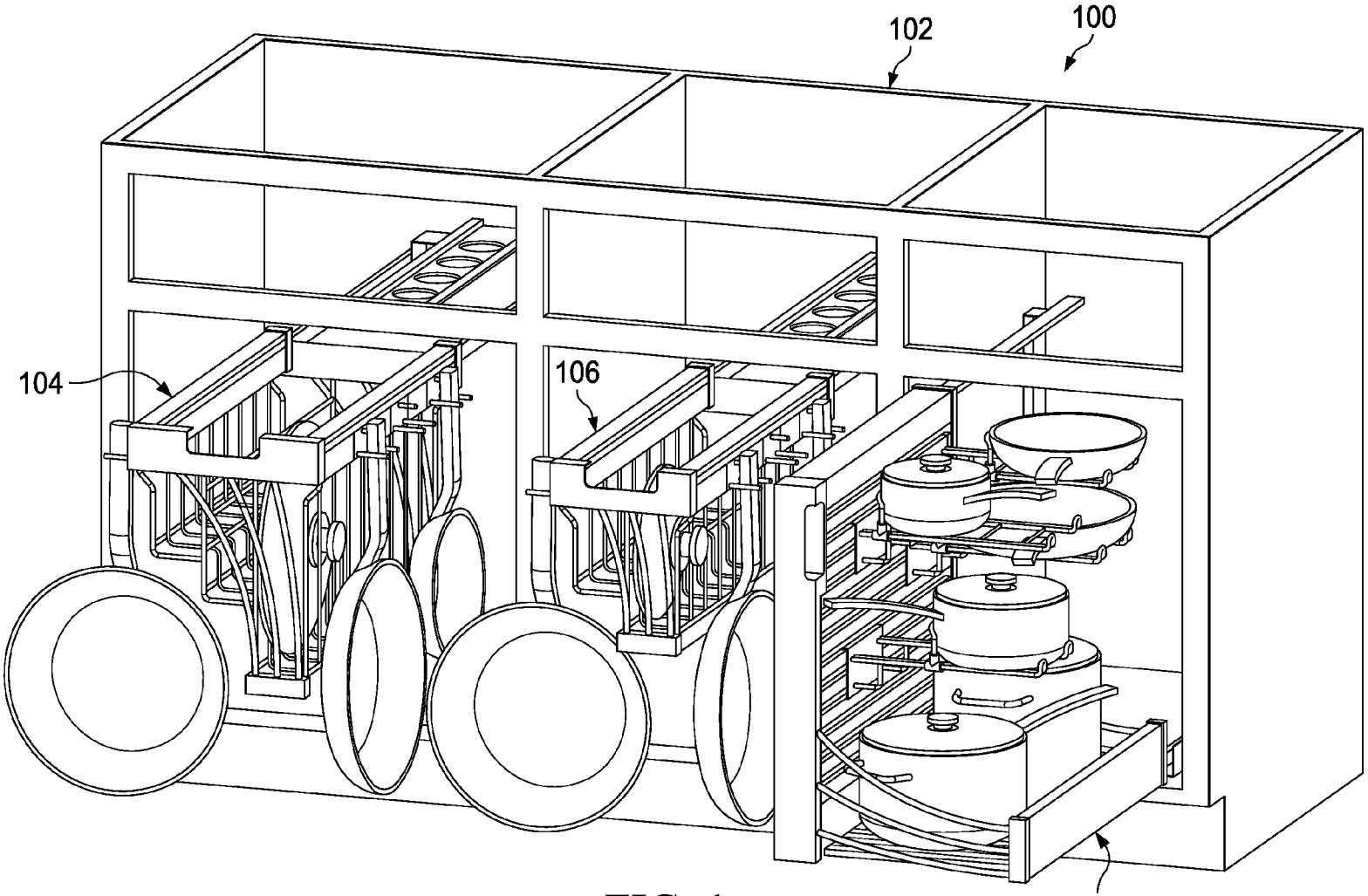
FIG. 1 is an isometric view of a preferred embodiment of a kitchen organizer extended from a cabinet carcass.

In the descriptions that follow, like parts are marked throughout the specification and drawings with the same numerals, respectively. The drawing figures are not necessarily drawn to scale and certain figures may be shown in exaggerated or generalized form in the interest of clarity and conciseness.

Referring to FIG. 1, kitchen organizer 100 is shown in a deployed position extending from separate openings in cabinet carcass 102. Kitchen organizer comprises at least one "V" shaped basket 104 or "L" shaped basket 108. "V" shaped basket 106 is identical to "V" shaped basket 104 however having smaller dimensions. Each basket of kitchen organizer 100 can be custom sized to fit any sized opening in the cabinet carcass. Each basket of kitchen organizer 100 can be deployed from cabinet carcass 102 independent of each other via separate slide assemblies. "V" shaped basket 104 slides independently from "V" shaped basket 106 which slides independently from "L" shaped basket 108. Kitchen organizer 100 may include any combination of "V" shaped and "L" shaped baskets depending on the application desired.

Figure 2:
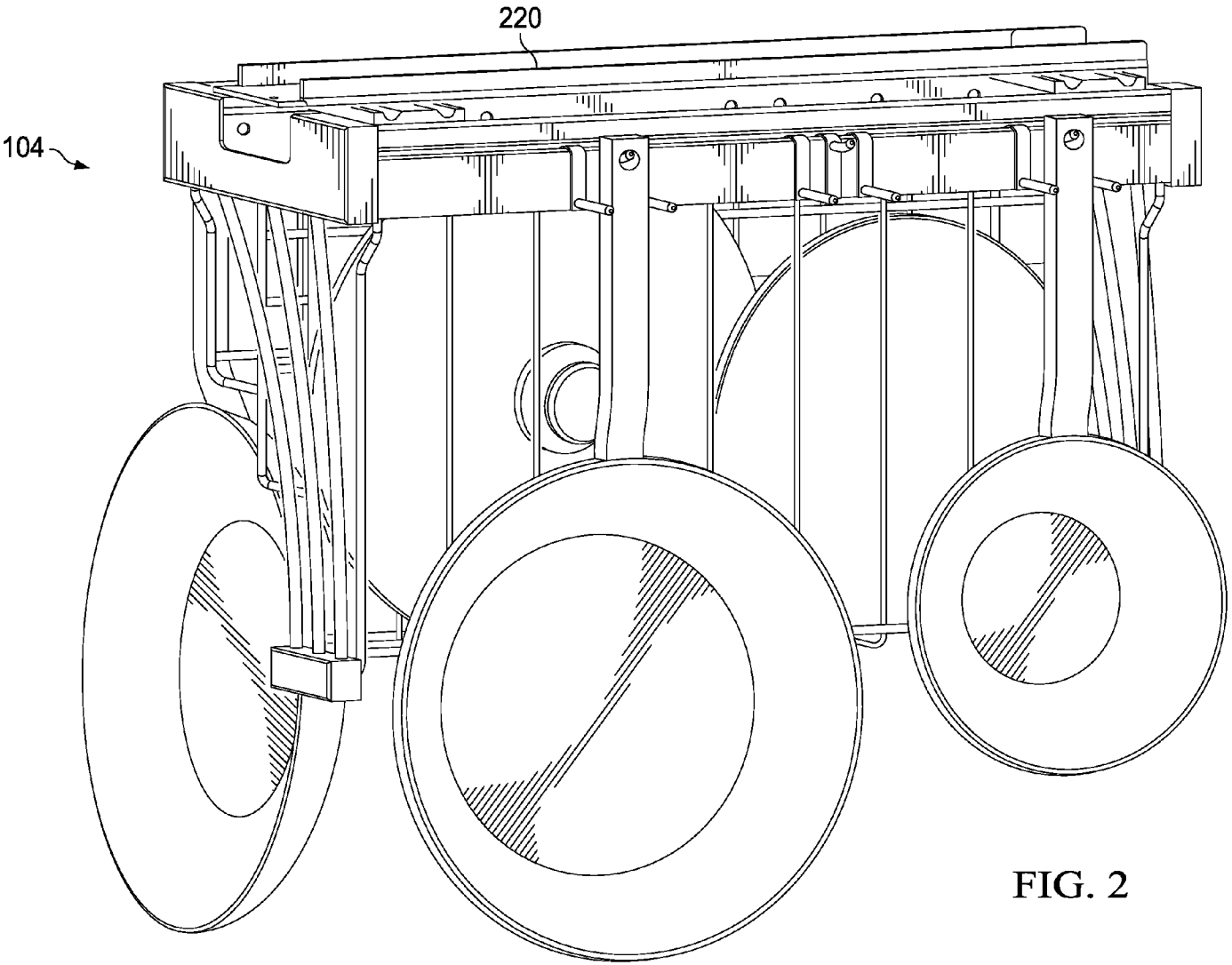
FIG. 2 is an isometric view of an assembled "V" shaped wire basket of a preferred embodiment.

Referring to FIG. 2, "V" shaped basket 104 is shown fully assembled and loaded with kitchen utensils such as pots and pans and their respective lids. "V" shaped basket 104 is mounted to the cabinet carcass via slide assembly 220. Slide assembly 220 allows "V" shaped basket 104 to slidably move between a stored position within the cabinet carcass and an extended position through a cabinet opening. Slide assembly 220 comprises frame 222 mounted to the cabinet carcass plus a pair of drawer slides mounted to frame 222 and "V" shaped basket 104.

Figure 3:
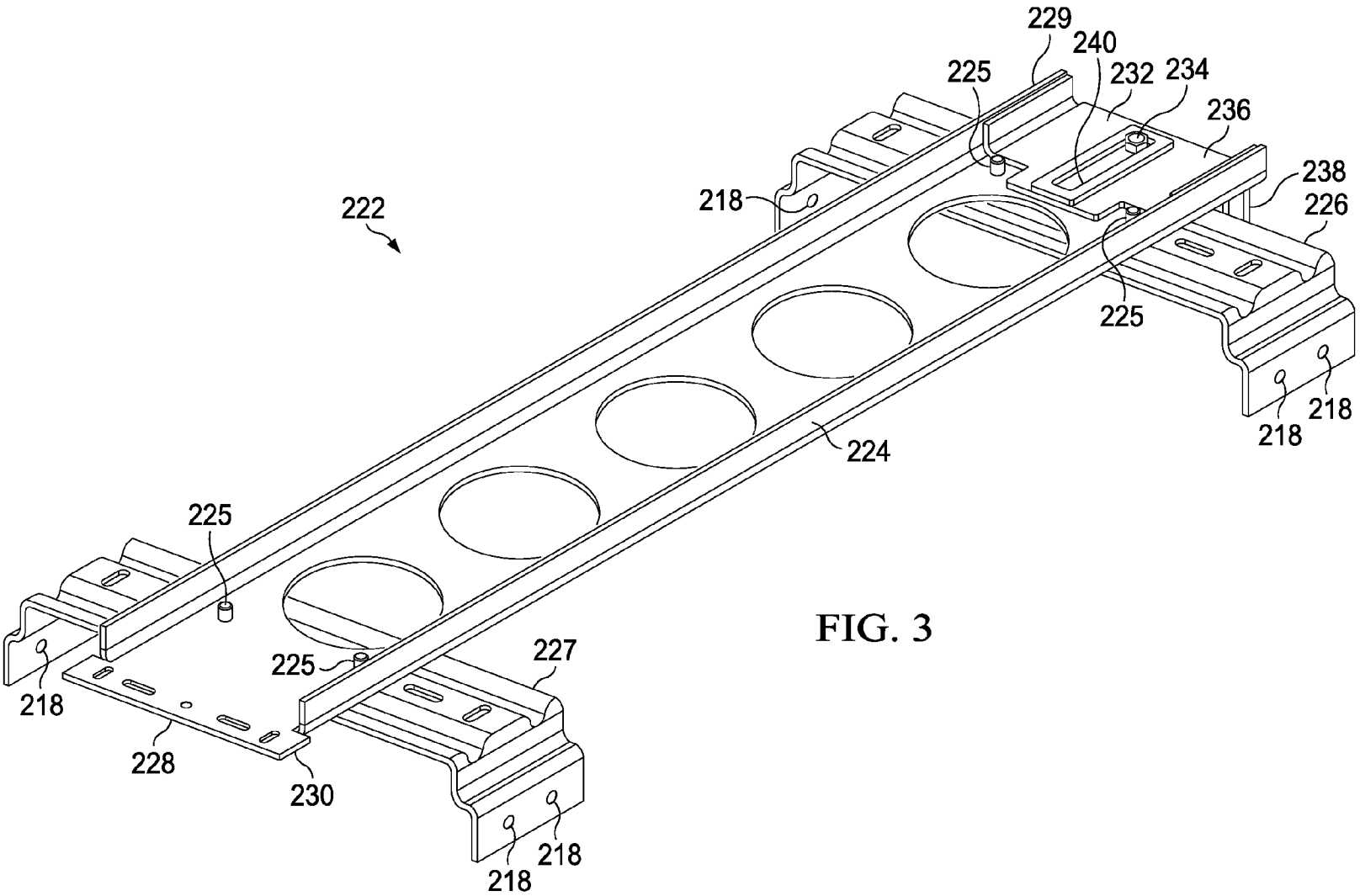
FIG. 3 is an isometric view of a mounting bracket assembly for the "V" shaped wire basket.

Referring to FIG. 3, frame 222 comprises a pair of U-brackets 226 and 227 attached to opposite ends of brace 224 preferably with screws 225 but could also be welded or riveted. Brace 224 extends generally perpendicularly between U-brackets 226 and 227. Each U-bracket defines opposing flanges which include mounting holes 218. Mounting holes 218 are used to attach drawer slide assemblies to frame 222. The drawer slide assemblies are commonly known and each may include two or three telescopically engaged drawer rails. At end 228, brace 224 defines mounting flange 230. Mounting flange 230 includes mounting holes for attaching end 228 of brace 224 to the face frame of the cabinet carcass. At end 229, rear bracket 232 is attached to brace 224 with nut and bolt 234 through slot 240. Rear bracket 232 is "L" shaped including flange 236 angled generally perpendicularly from flange 238. Flange 236 includes slot 240 which is oriented parallel to the direction of travel of "V" shaped basket 104 in and out of the cabinet carcass via slide assembly 220. Flange 238 includes mounting holes for attachment of rear bracket 232 to the back wall of cabinet carcass 102. Slot 240, in cooperation with nut and bolt 234, allow a one-handed depth adjustment to compensate for different depth cabinets. In an alternate embodiment, U-brackets 226 and 227 are mounted directly to cabinet carcass 102 without brace 224 for frameless applications.

Figure 4:
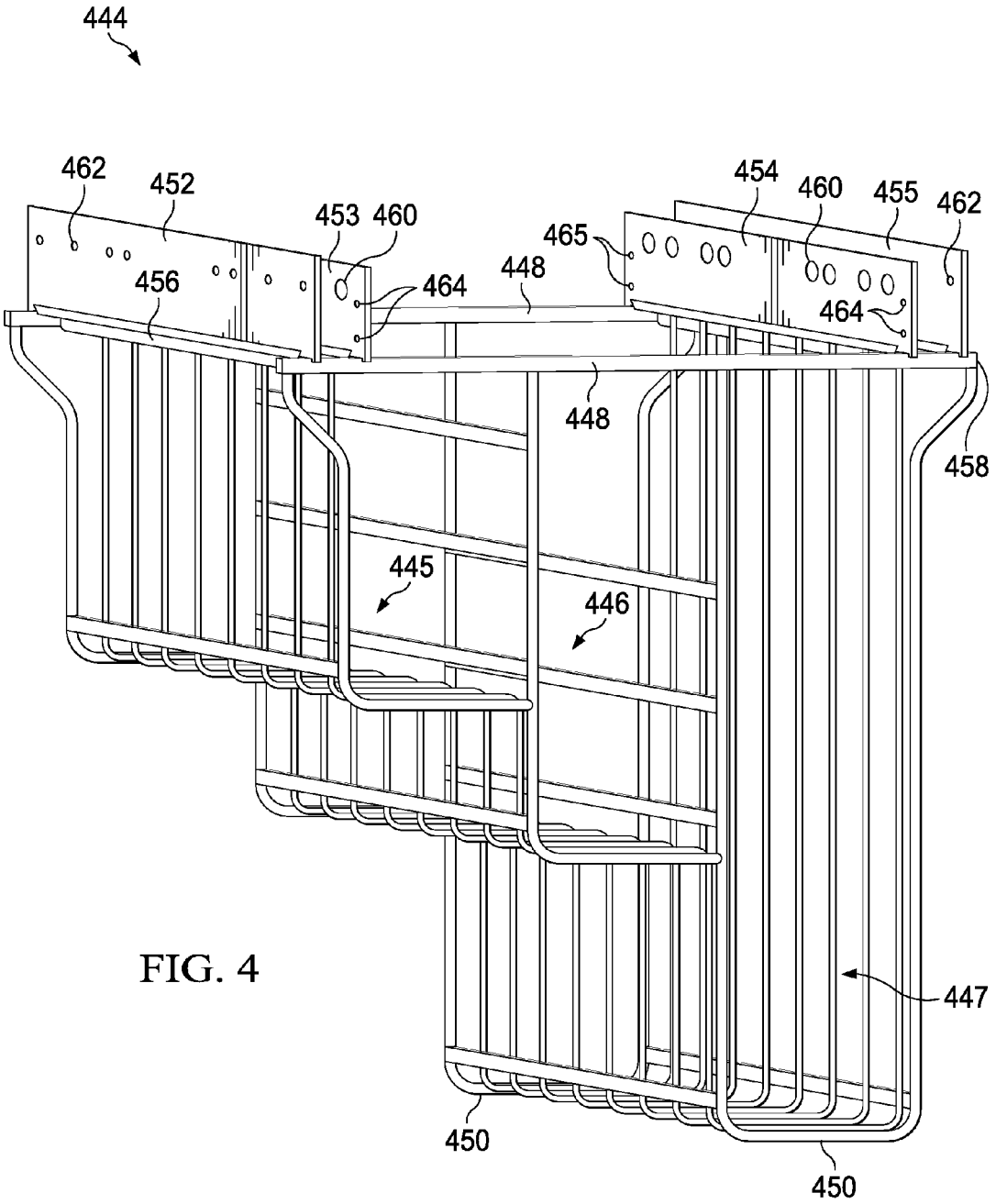
FIG. 4 is an isometric view of the "V" shaped basket frame.

Wire basket frame 444 is shown in FIG. 4. Wire basket frame 444 is generally "V" shaped and includes three stepped and separated pockets 445, 446, and 447. In alternate embodiments, wire basket frame 444 is comprised of one or more pockets. The upper end of wire basket frame 444 includes cross wires 448 and the lower end of pocket 447 includes cross supports 450. Flanges 452 and 453 are attached to and extend from cross wires 448 at end 456 of wire basket frame 444. Flanges 454 and 455 are attached to and extend from cross wires 448 at end 458 of wire basket frame 444. Flanges 452 and 453 are generally parallel to each other and spaced apart such that a drawer slide assembly can be attached to flange 452 in the gap between flanges 452 and 453. Likewise, flanges 454 and 455 are generally parallel to each other and spaced apart such that a drawer slide assembly can be attached to flange 455 in the gap between flanges 454 and 455. Flanges 452 and 455 include a series of mounting holes 462. Mounting holes 462 are used to attach drawer slide assemblies to flanges 452 and 455 with bolts and nuts. Flanges 453 and 454 include a series of access holes 460. Access holes 460 are axially aligned with mounting holes 462 and provide access to the bolts that attach the drawer slide assemblies to flanges 452 and 455. Flanges 453 and 454 further includes mounting holes 464 proximate one end and mounting holes 465 proximate the opposite end.

Figure 5:
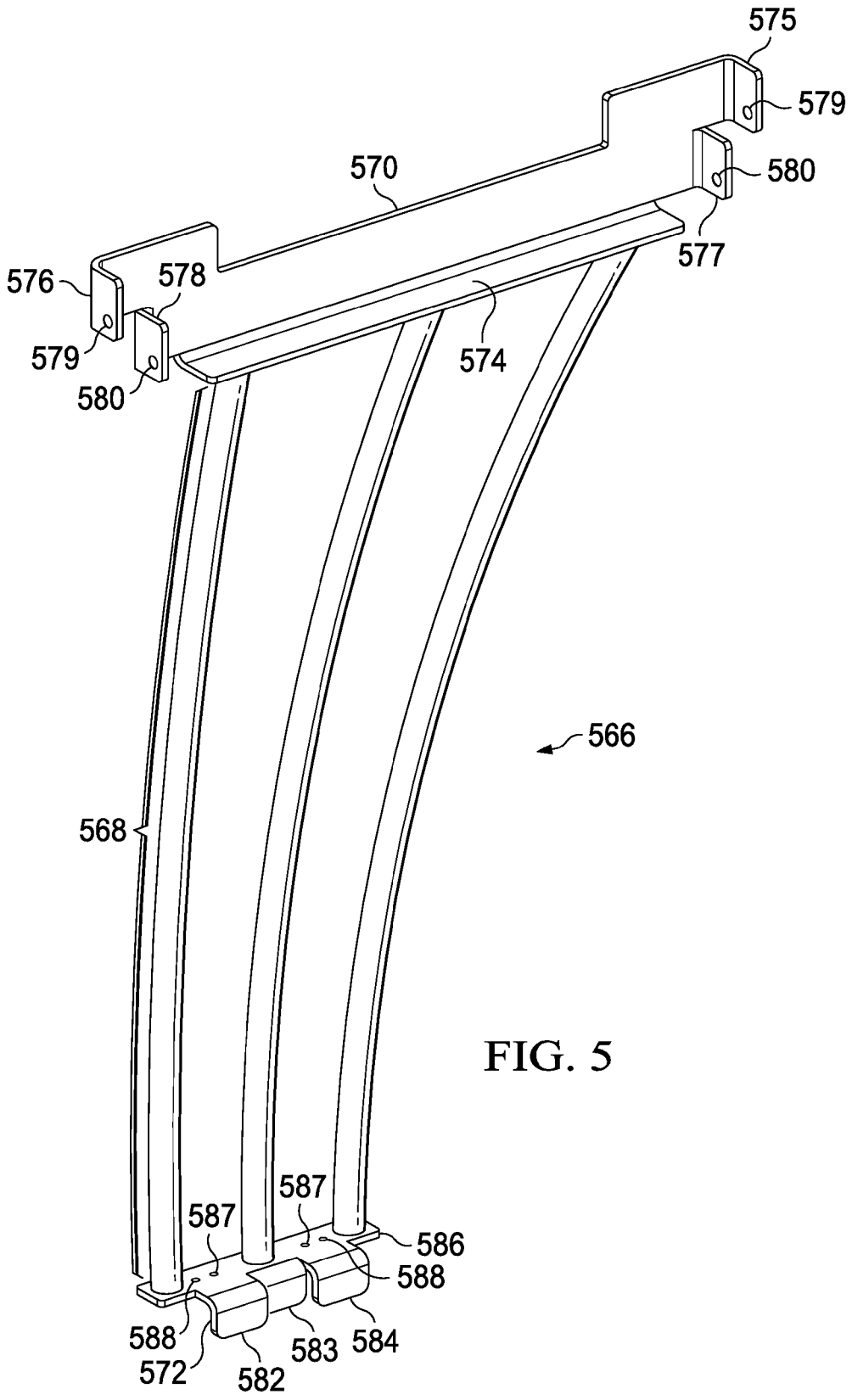
FIG. 5 is an isometric view of a support of the "V" shaped basket.

Referring to FIG. 5, curved weldment 566 comprises three uprights 568 connected between upper bracket 570 and lower bracket 572. "V" shaped basket 104 includes two curved weldments, the other being a mirror image of weldment 566. For simplicity, only one curved weldment will be described. Upper bracket 570 includes base 574 connected to uprights 568. Flanges 575, 576, 577, and 578 extend from base 574. Flanges 575 and 576 include mounting holes 579 while flanges 577 and 578 include mounting holes 580. Lower bracket 572 includes prongs 582, 583, and 584 extending from base 586. Prongs 582 and 584 are positioned generally in a shared plane while prong 583 is positioned between prongs 582 and 584 in an alternate plane creating a gap between the two planes. Base 586 is connected to uprights 568 and further includes attachment holes 587 and 588. Mounting hardware such as screws or rivets through mounting holes 579 in flanges 575 and 576 and mounting holes 464 in flanges 453 and 454 attaches curved weldment 566 to one side of wire basket frame 444. Mounting holes 579 in flanges 575 and 576 in a second curved weldment 566 aligned with mounting holes 465 in flanges 453 and 454 provide attachment points for the second curved weldment on the opposite side of wire basket frame 444. Additionally, cross supports 450 are seated in the gap between the prongs of lower bracket 572 of both curved weldments. In alternate embodiments, curved weldments do not need to be curved as other patterns will suffice.

Figure 6A:
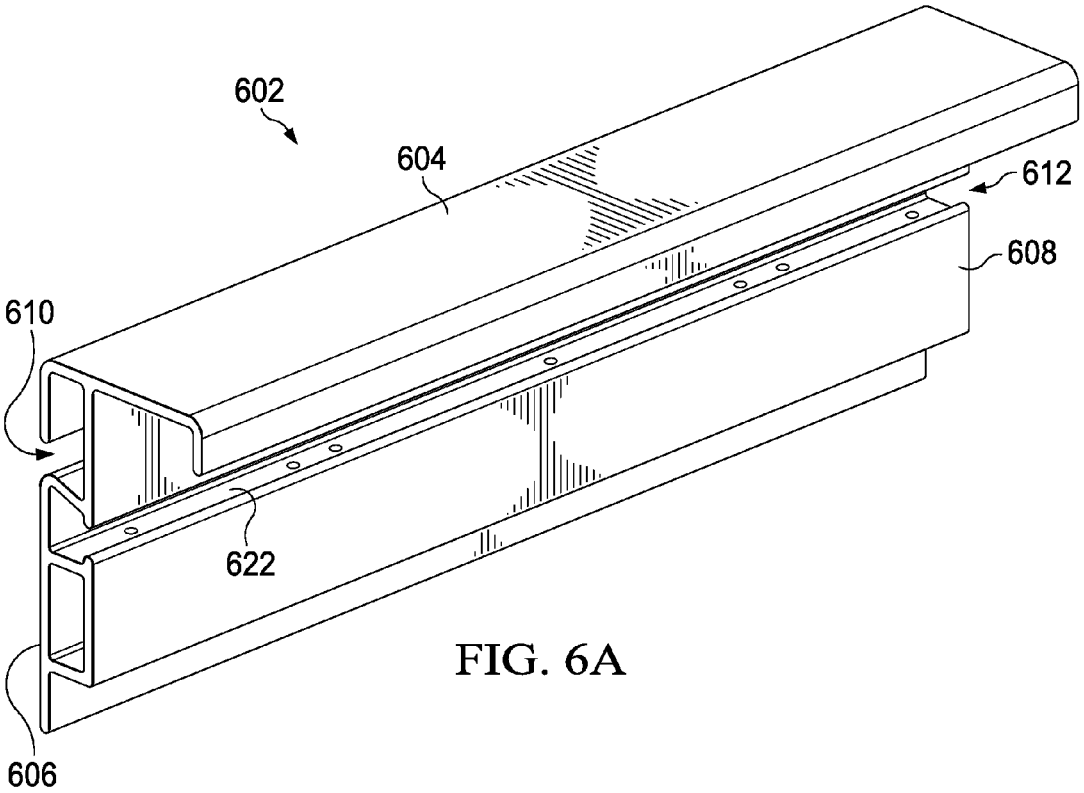
FIG. 6A is an isometric view of a slat of the "V" shaped basket.
Figure 6B:
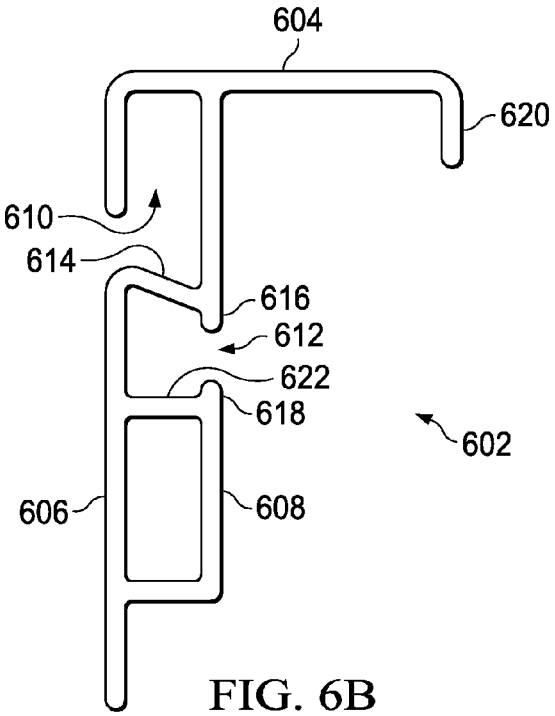
FIG. 6B is a cross-section view of a slat of the "V" shaped basket.

Referring to FIGS. 6A and 6B, slat 602 is an extruded plastic or aluminum piece having a distinct cross-section. Slat 602 comprises a top side 604 integrally formed with a face side 606 and a back side 608. Face side 606 includes a lengthwise groove 610. Interior to groove 610 is slanted surface 614. Back side 608 includes a lengthwise groove 612. Groove 612 includes flat surface 622. Formed at the opening to groove 612 are ridges 616 and 618. Top side 604 includes a lengthwise extension 620.

Figure 7A:
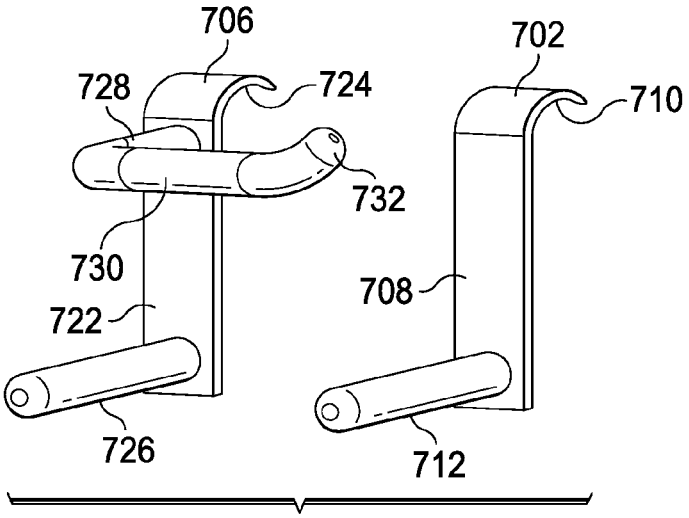
FIG. 7A is an isometric view of a set of hooks for attachment to the slat of the "V" shaped basket.
Figure 7B:
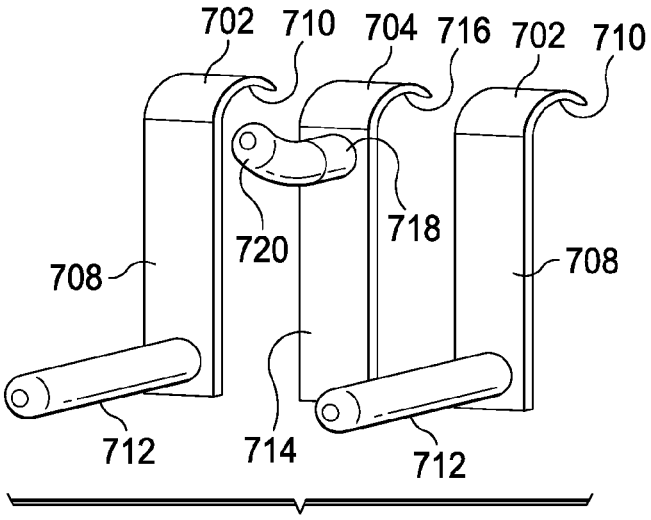
FIG. 7B is an isometric view of an alternate set of hooks for attachment to the slat of the "V" shaped basket.

Referring to FIGS. 7A and 7B, hooks 702, 704, and 706 for attachment to slat 602 are shown. Hook 702 is a generally flat body 708 which includes flange 710 shaped on one end and pin 712 extending generally perpendicular from body 708 at an opposite end. Flange 710 forms an angle that matches the angle of slanted surface 614. Hook 704 is a generally flat body 714 including flange 716 shaped on one end and pin 718 extending generally perpendicularly from body 714 at the same end. Flange 716 forms an angle that matches the angle of slanted surface 614. Pin 718 includes upturned segment 720. Hook 706 is a generally flat body 722 which includes flange 724 shaped on one end and pin 726 extending generally perpendicular from body 722 at an opposite end. Pin 728 extends from body 728 proximate flange 724. Pin 728 includes a bend forming horizontal segment 730. Pin 728 further includes upturned end 732. The hooks are interchangeably attached to the slat to provide hanging points for pots and pans. Hooks 702, 704, and 706 can be positioned on the slat in any desired arrangement. The upturned ends of pins 718 and 728 of hooks 704 and 706, respectively, prevent a pot handle from sliding off the pins. Pins 712 of hooks 702 positioned adjacent to hooks 704 and 706 prevent a hanging pot from swaying while the kitchen organizer is being deployed from a cabinet.

Figure 8:
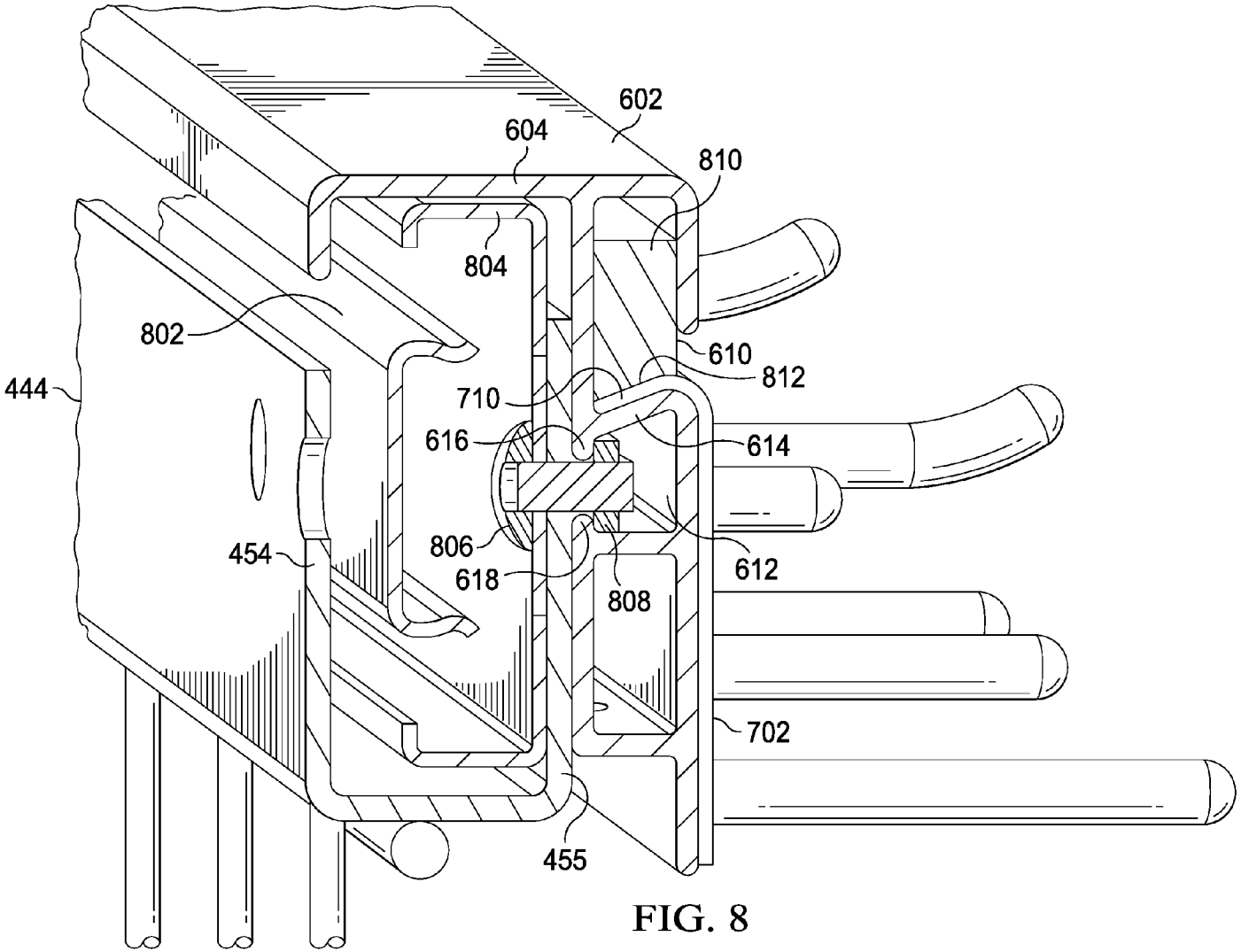
FIG. 8 is an isometric, cross-sectional view of a slide assembly and the slat attached to the "V" shaped basket frame.

FIG. 8 shows slat 602 mounted to wire basket frame 444. A typical drawer slide includes at least an inner rail 802 telescopically engaged with an outer rail 804. Inner rail 802 is mounted to U-brackets 226 and 227 via mounting holes 218. Outer rail 804 is mounted to wire basket frame 444 via flange 455. Bolts 806 pass through outer rail 804 and mounting holes 462 in flange 455. Nuts 808 are engaged with bolts 806 to provide a row of linearly aligned nuts. Slat 602 is mounted to wire basket frame 444 by sliding groove 612 over the row of nuts. Ridges 616 and 618 prevent the nuts from passing through the opening to groove 612. In an alternate embodiment, groove 612 is not present and slat 602 is directly mounted to wire basket frame with typical mounting hardware such as screws or rivets. Back side 608 is adjacent flange 455 and top side 604 covers flange 455, outer rail 804 and inner rail 802. Access holes 460 allow a tool to pass through flange 454 to access bolts 806. Flat surface 622 prevents rotation of nuts 808 as bolts 806 are tightened. All hooks 702, 704, and 706 are removably attached to slat 602 in groove 610 in an identical manner. For example flange 710 of hook 702 is placed adjacent slanted surface 614. Bar 810 is seated lengthwise throughout groove 610. Bar 810 has angled edge 812. Angled edge 812 forms an angle that matches the angle of flange 710 and slanted surface 614. Bar 810 clamps down on flange 710 to secure hook 702 in place.

Figure 9A:
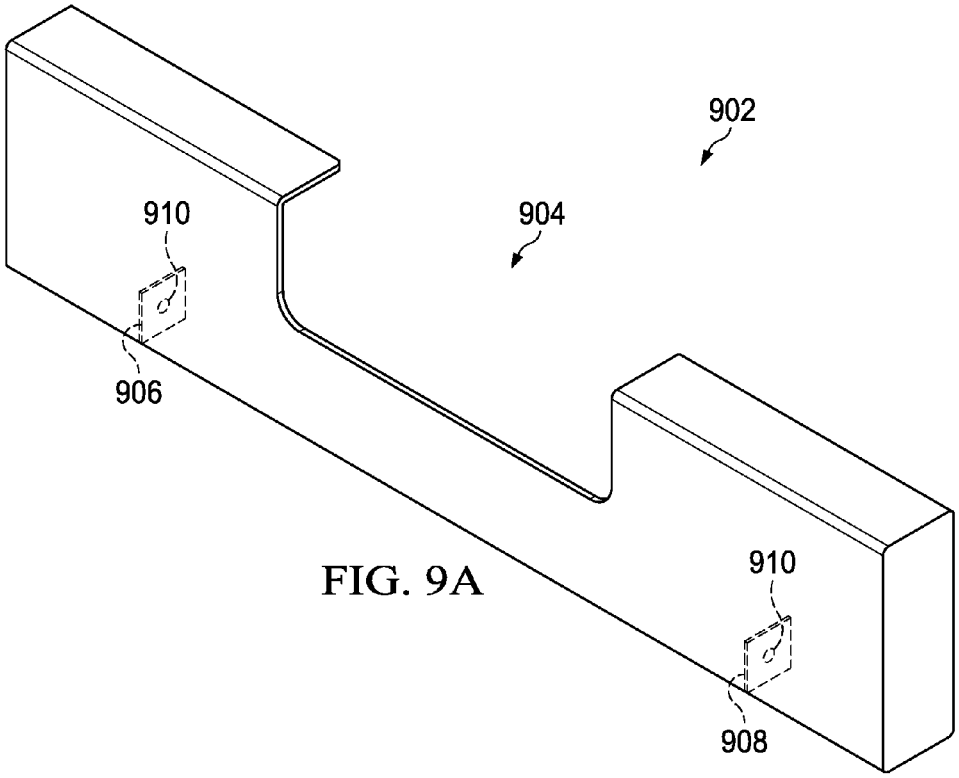
FIG. 9A is an isometric view of a front cover.
Figure 9B:
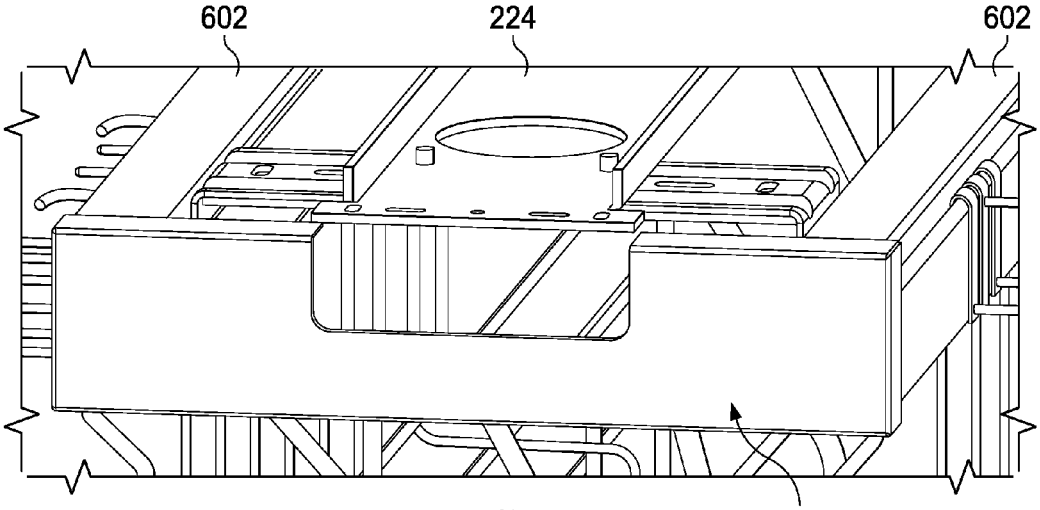
FIG. 9B is an isometric view of a front cover attached to the "V" shaped basket frame.

FIGS. 9A and 9B show front cover 902 and front cover 902 attached to curved weldment 566. Front cover 902 is generally a hollow rectangle. The top edge of front cover 902 includes notch 904. Interior to front cover 902 are flanges 906 and 908. Flanges 906 and 908 include mounting holes 910. Mounting hardware such as screws or rivets through mounting holes 910 in flanges 906 and 908 paired with mounting holes 580 in flanges 577 and 578 attaches front cover 902 to curved weldment 566. Front cover 902 conceals the ends of slat 602; the ends of the drawer slide assembly; the ends of flanges 452, 453, 454, and 455; and upper bracket 570. Notch 904 provides a handle from which "V" shaped basket 104 may be deployed.

Figure 10A:
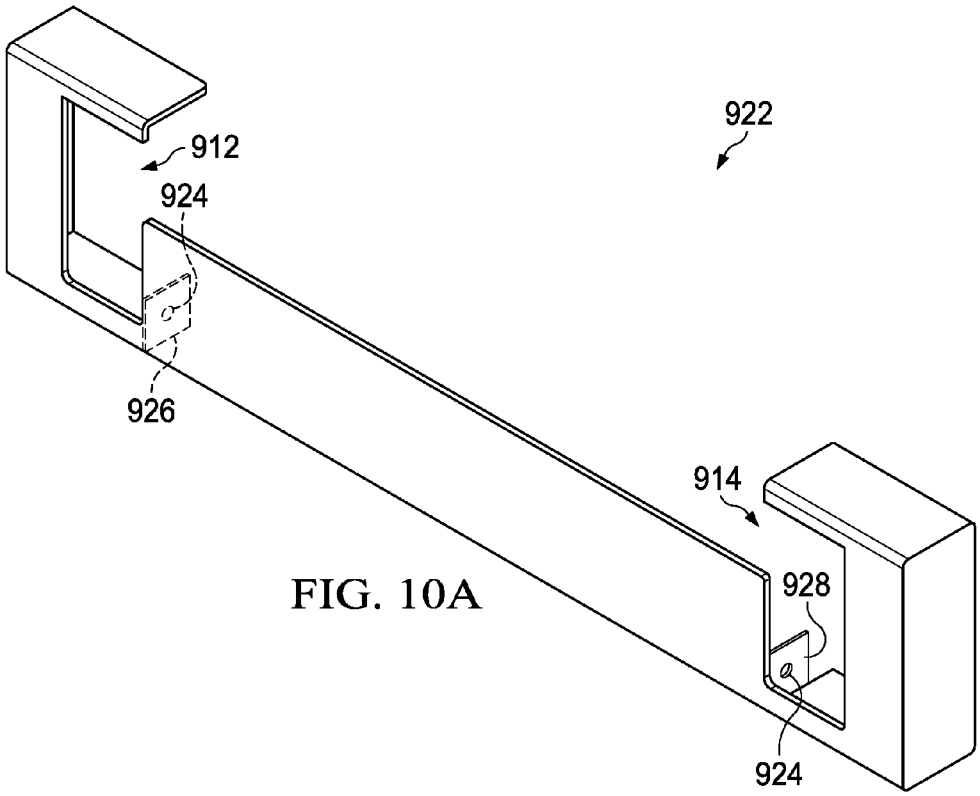
FIG. 10A is an isometric view of a rear cover.
Figure 10B:
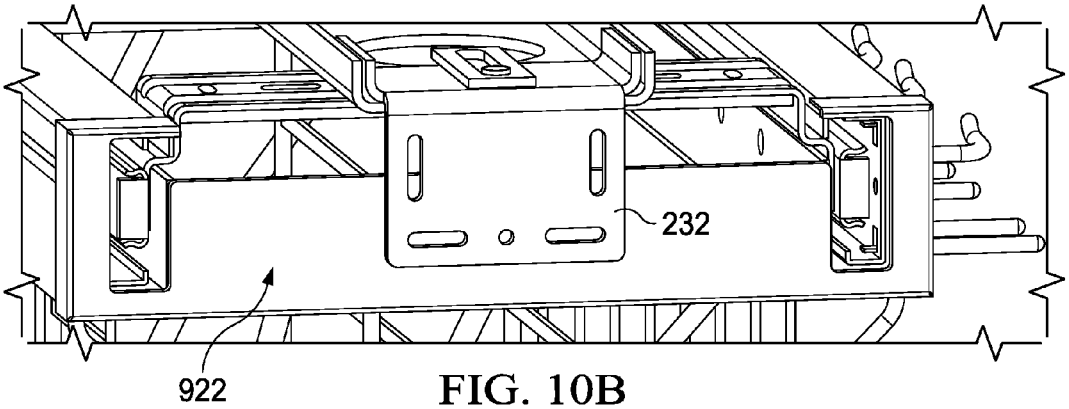
FIG. 10B is an isometric view of a rear cover attached to the "V" shaped basket frame.

FIGS. 10A and 10B show rear cover 922 and rear cover 922 attached to curved weldment 566. Rear cover 922 is generally a hollow rectangle including cutouts 912 and 914. Interior to rear cover 922 are flanges 926 and 928. Flanges 926 and 928 include mounting holes 924. Mounting hardware such as screws or rivets through mounting holes 924 in flanges 926 and 928 and mounting holes 465 in flanges 577 and 578 attaches rear cover 922 to a second curved weldment 566. Cutouts 912 and 914 allow inner rail 802 to pass through during deployment and storing of "V" shaped basket 104.

Figure 11A:
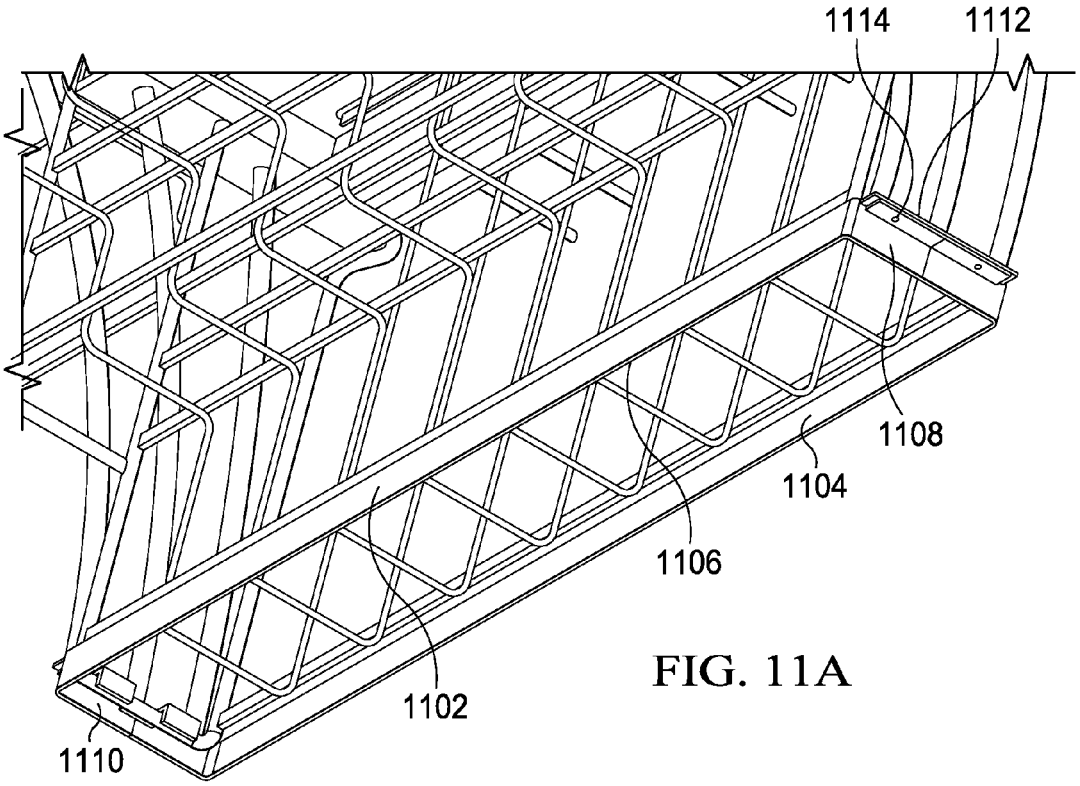
FIG. 11A is an isometric view of a pair of side covers attached to the "V" shaped basket frame.

Referring to FIG. 11A, side covers 1102 and 1104 are attached to the bottom of wire basket frame 444 and curved weldments 566. Side cover 1102 is a mirror image of side cover 1104. Accordingly, side cover 1102 (and correspondingly side cover 1104) is comprised of rail 1106 extending between ends 1108 and 1110. Each end 1108 and 1110 includes flange 1112. Flange 1112 defines mounting hole 1114. Side covers 1102 and 1104 wrap around the bottom of pocket 447. Mounting hardware through mounting holes 1114 and mounting holes 588 secures side covers 1102 and 1104 to curved weldments 566 on both the front and rear ends of wire basket frame 444.

Figure 11B:
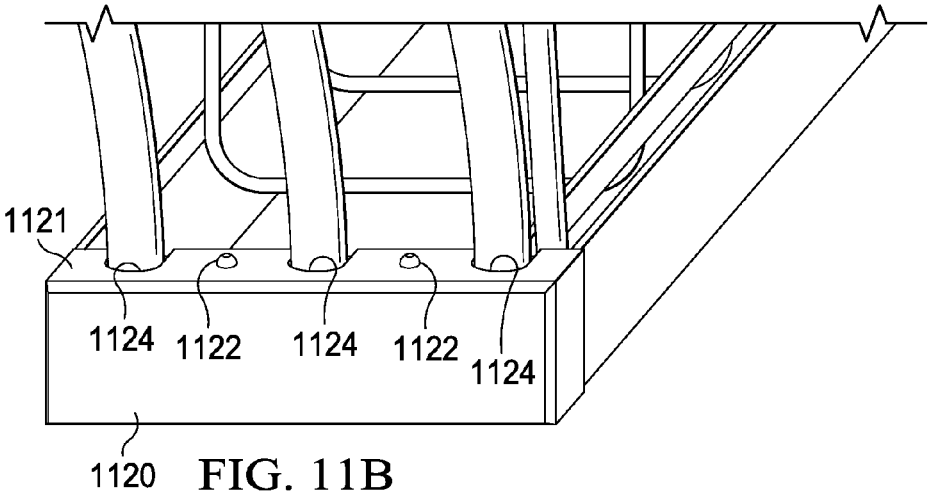
FIG. 11B is an isometric view of a lower cover attached to the "V" shaped basket frame.

Referring to FIG. 11B, lower cover 1120 is generally rectangular and hollow. Upper surface 1121 of lower cover 1120 includes three notches 1124 sized to accept uprights 468. Upper surface 1121 further includes mounting holes 1122. Lower cover 1120 is mounted to curved weldment 566 through mounting holes 1122 and mounting holes 587. A lower cover is attached to both the front and rear ends of wire basket frame 444.

Figure 12:
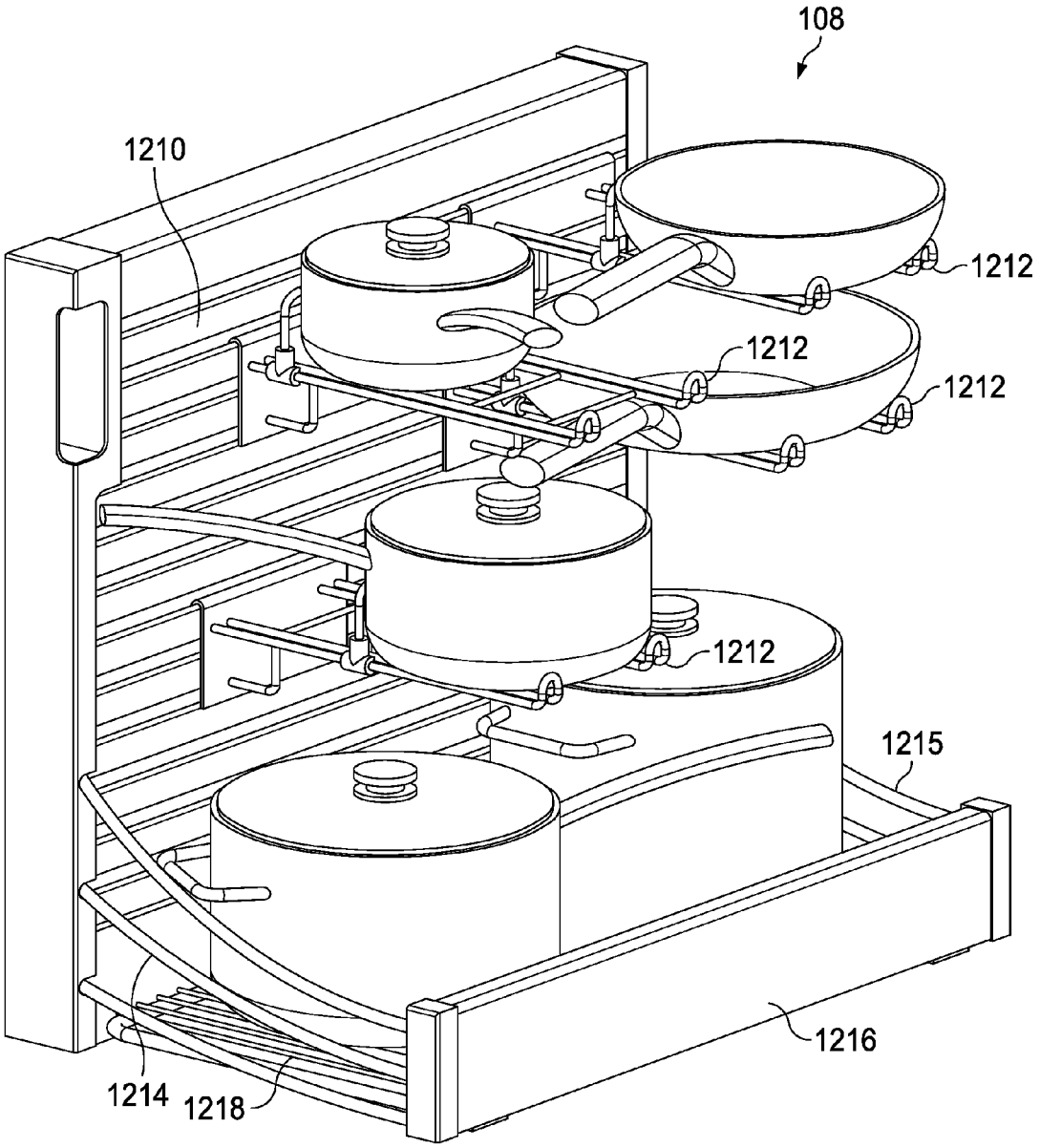
FIG. 12 is an isometric view of an assembled "L" shaped wire basket of a preferred embodiment.

Referring to FIG. 12, "L" shaped basket 108 is shown fully assembled and stocked with pots and pans. "L" shaped basket 108 is mounted to the cabinet carcass via slide assembly 1302. Slide assembly 1302 allows "L" shaped basket 108 to slidably move between a stored position within the cabinet carcass and an extended position through a cabinet opening. "L" shaped basket 108 comprises slatwall 1210 attached to a frame. A pair of curved weldments 1214 and 1215 are connected to the frame and to housing 1216. In alternate embodiments, curved weldments do not need to be curved as other shapes will suffice. Wire shelf 1218 extends between slatwall 1210 and housing 1216. Shelves 1212 are removably attached to slatwall 1210.

Figure 13:
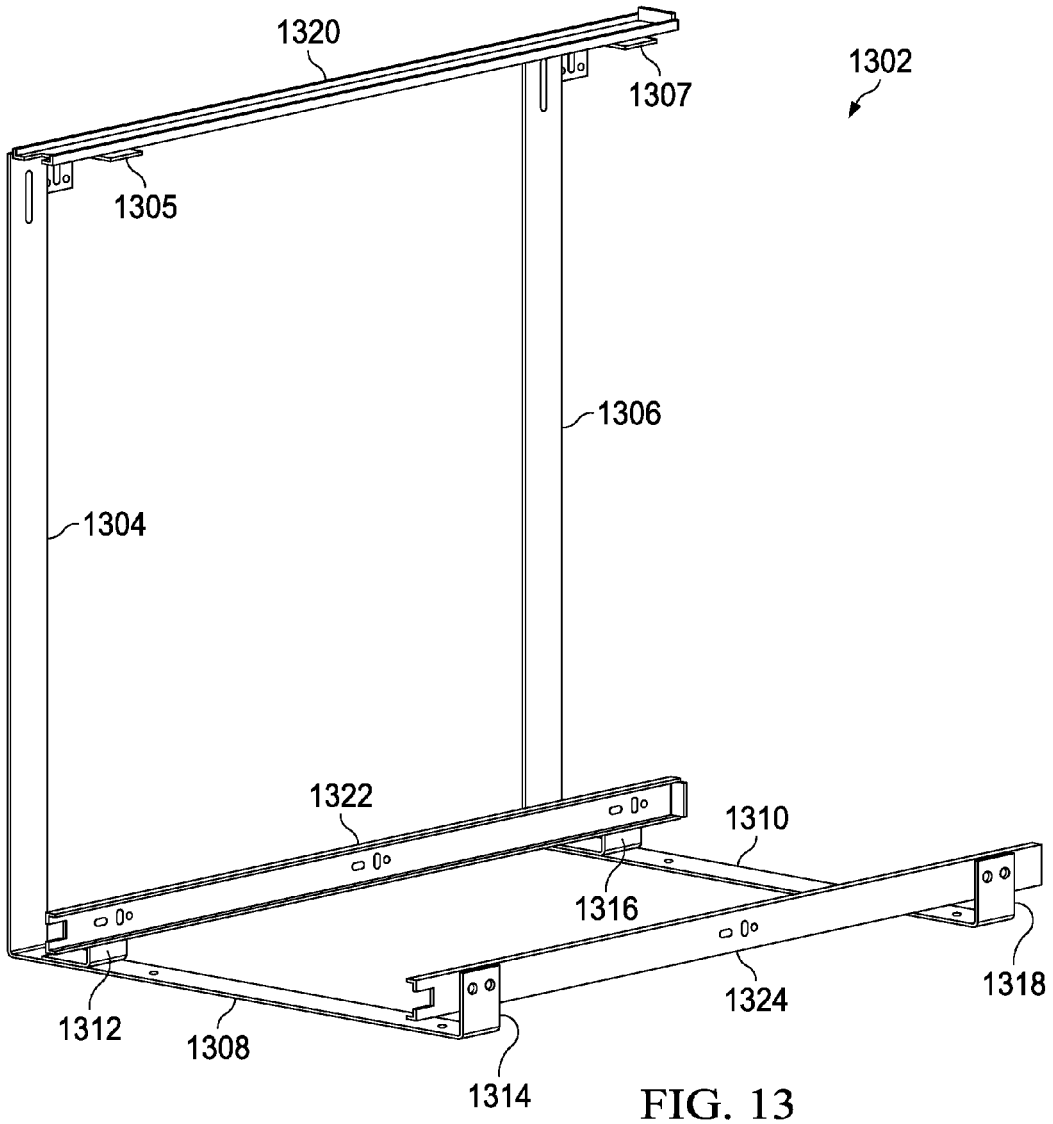
FIG. 13 is an isometric view of a mounting bracket assembly for the "L" shaped wire basket.

Referring to FIG. 13, slide assembly 1302 comprises vertical supports 1304 and 1306 mounted to a side wall of the cabinet carcass. Flanges 1305 and 1307 extend generally horizontally from the upper ends of vertical supports 1304 and 1306, respectively. Inner rail 1320 of a typical drawer slide is adjustably mounted to flanges 1305 and 1307 through horizontal slots in flanges 1305 and 1307. The vertical supports are integrally formed with or connected to horizontal supports 1308 and 1310. Horizontal supports 1308 and 1310 are mounted to the floor surface of a cabinet carcass. Horizontal support 1308 includes vertically extending flanges 1312 and 1314. Horizontal support 1310 includes vertically extending flanges 1316 and 1318. Inner rail 1322 of a common drawer slide is adjustably mounted to flanges 1312 and 1316 via horizontal slots in flanges 1312 and 1316. The side-to-side orientation (from the perspective of the cabinet carcass) of inner rails 1320 and 1322 can be adjusted via their connections to flanges 1305, 1307, 1312, and 1316 to accommodate different sized cabinets. Inner rail 1324 of a common drawer slide is mounted to flanges 1314 and 1318.

Figure 14:
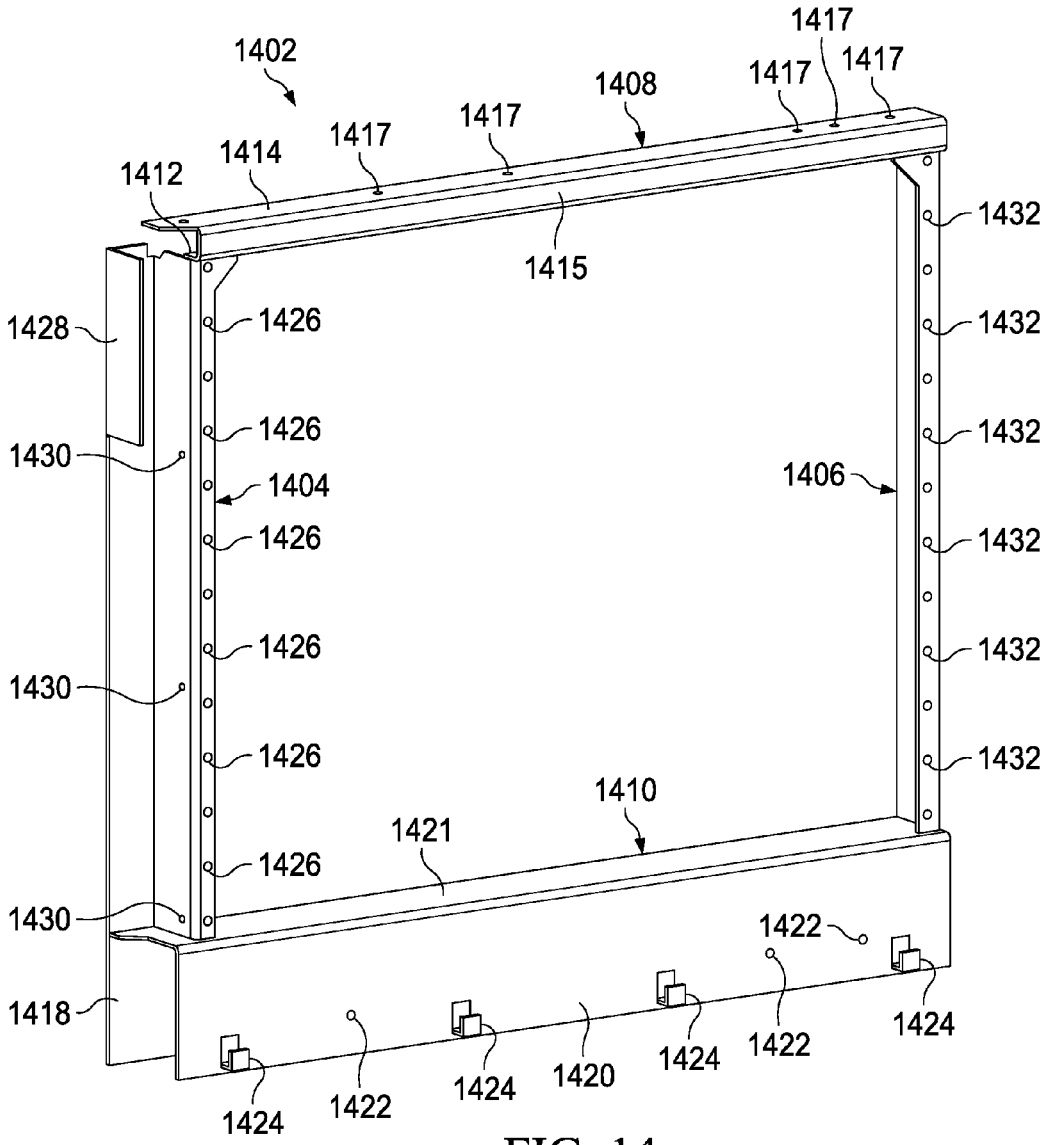
FIG. 14 is an isometric view of the "L" shaped basket frame.

Referring to FIG. 14, frame 1402 is comprised of vertical supports 1404 and 1406 connected to and extending between housing 1408 and housing 1410. Housing 1408 comprises flanges 1412 and 1414 oriented generally horizontally and parallel to each other extending the length of housing 1408. Flanges 1412 and 1414 are connected to each other by web 1415. Flange 1414 includes a series of mounting holes 1417. Mounting holes 1417 are used to mount an outer rail that is telescopically engaged with inner rail 1320. Housing 1410 comprises flanges 1418 and 1420 oriented generally vertically and parallel to each other extending the length of housing 1410. Flanges 1418 and 1420 are connected to each other by web 1421. Flange 1420 includes a series of mounting holes 1422 and a series of hooks 1424. Mounting holes 1422 are used to mount an outer rail that is telescopically engaged with inner rail 1322. Hooks 1424 are used to support wire shelf 1218. Vertical support 1404 includes a series of evenly spaced holes 1426 and flange 1428. Vertical support 1404 further includes mounting holes 1430. Vertical support 1406 includes a series of evenly spaced holes 1432. Holes 1426 and holes 1432 are aligned.

Figure 15A:
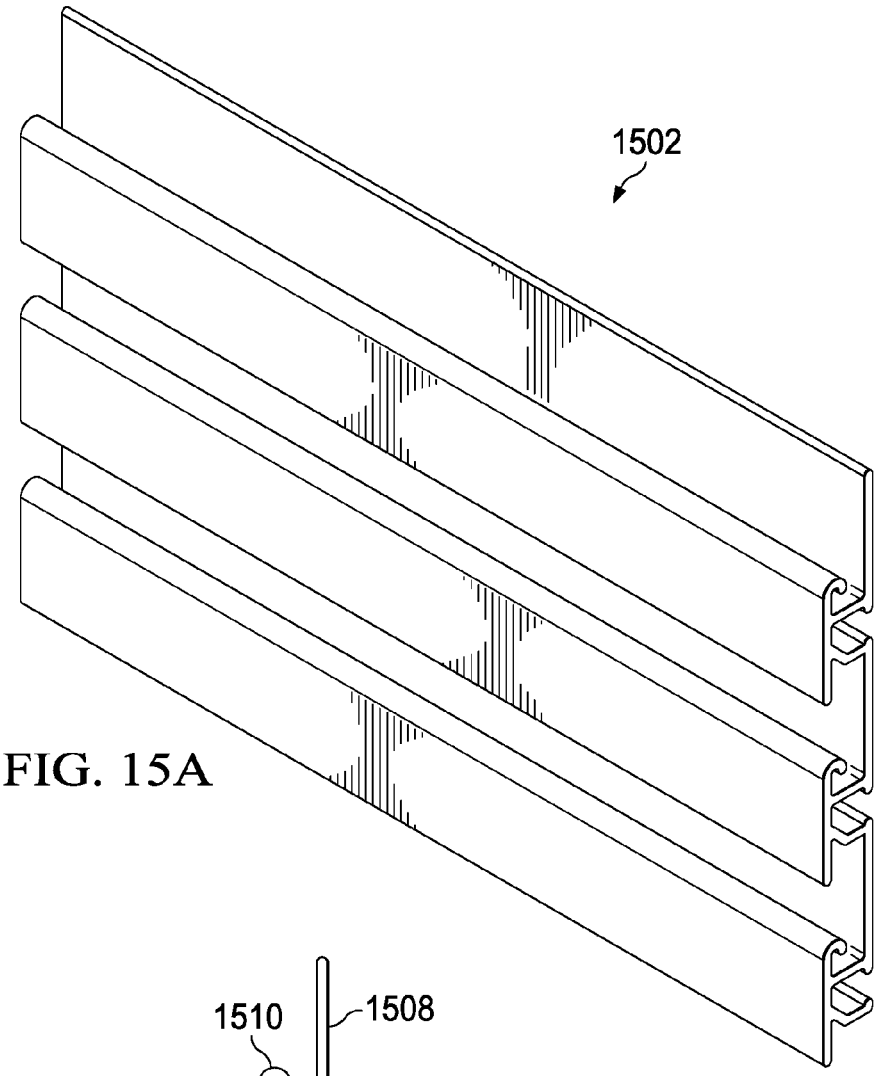
FIG. 15A is an isometric view of a slat of the "L" shaped basket.
Figure 15B:
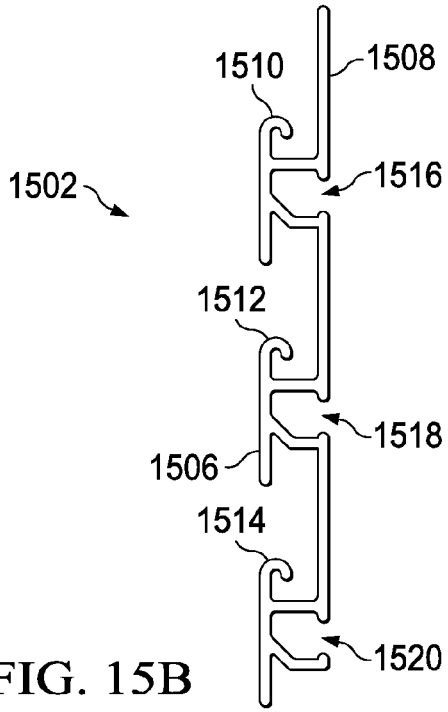
FIG. 15B is a cross-section view of a slat of the "L" shaped basket.

Referring to FIGS. 15A and 15B, slat 1502 is an extruded plastic or aluminum piece having a distinct cross-section. Slat 1502 comprises face side 1506 and back side 1508. Face side 1506 includes a series of hooks 1510, 1512, and 1514. Back side 1508 includes a series of lengthwise grooves 1516, 1518, and 1520. Grooves 1516, 1518, and 1520 are evenly spaced from each other and match the spacing between holes 1426 and 1432. Groove 1516 is proximate hook 1510, groove 1518 is proximate hook 1512, and groove 1520 is proximate hook 1514. A pair of opposing ridges constrict the openings to each groove.

Figure 16:
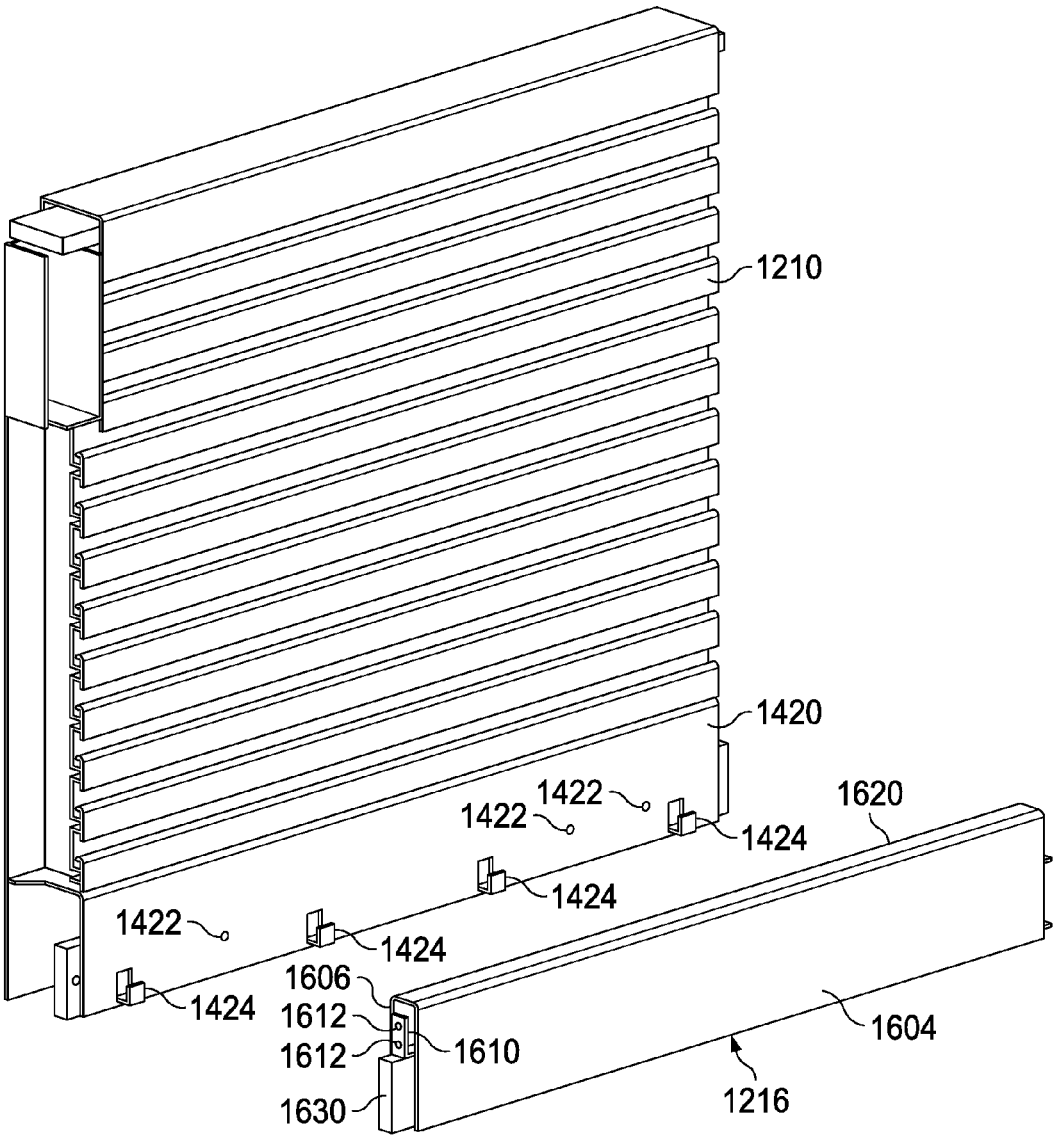
FIG. 16 is an isometric view of a set of slats attached to the "L" shaped basket frame.

Referring to FIG. 16, slatwall 1210 is comprised of a plurality of slats 1502 attached to vertical supports 1404 and 1406. Bolts (not shown) pass through holes 1426 and 1432. Nuts (not shown) are engaged with the bolts. Leaving the uppermost nut on both vertical supports exposed, each slat 1502 is placed over the remaining exposed nuts such that the nuts engage grooves 1516, 1518, and 1520. The ridges at the openings of each groove cooperate with the nuts to secure the slats to frame 1402. Housing 1216 comprises flanges 1604 and 1606 oriented generally vertically and parallel to each other extending the length of housing 1216. Housing 1216 includes flanges 1610 at each end. Flanges 1610 define mounting holes 1612. Flanges 1604 and 1606 are connected to each other by web 1620. Flange 1606 includes a series of mounting holes and a series of hooks matching and aligned with mounting holes 1422 and hooks 1424 of flange 1420. The mounting holes in flange 1606 are used to mount outer rail 1630 that is telescopically engaged with inner rail 1324. The hooks are used to support wire shelf 1218 as wire shelf 1218 extends between flanges 1420 and 1606.

Figure 17:
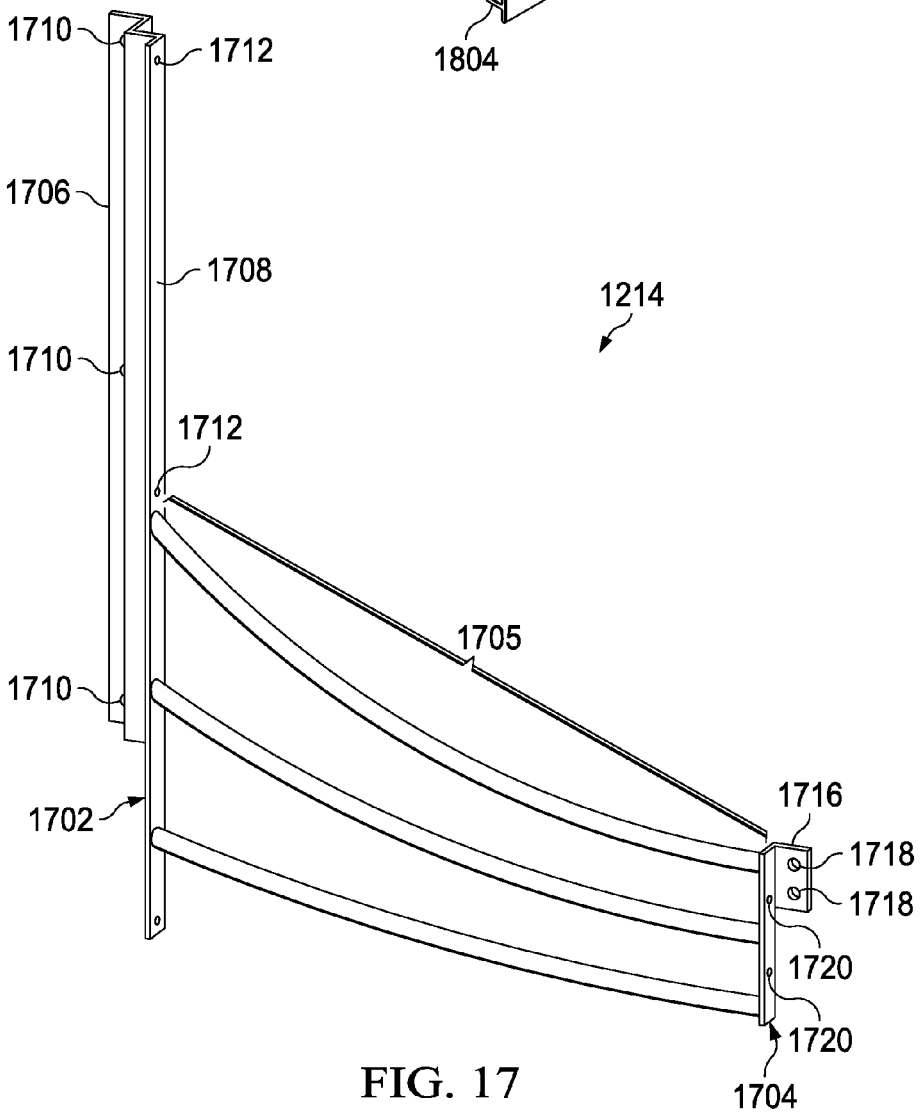
FIG. 17 is an isometric view of a support of the "L" shaped basket.

Referring to FIG. 17, curved weldment 1214 comprises three braces 1705 connected between bracket 1702 and bracket 1704. "L" shaped basket 108 includes two curved weldments 1214 and 1215. Curved weldment 1215 being a mirror image of curved weldment 1214. For simplicity, only one curved weldment will be described. Bracket 1702 comprises flange 1706 integrally formed with or connected to flange 1708. Flange 1706 is vertically oriented and includes mounting holes 1710. Flange 1708 includes mounting holes 1712 and is connected to braces 1705. Flange 1704 is vertically oriented and is connected to braces 1705. Flange 1704 includes mounting holes 1720. Flange 1716 extends generally perpendicularly from flange 1704 and further includes mounting holes 1718.

Curved weldment 1214 is attached to vertical support 1404 with mounting hardware such as crews or rivets through mounting holes 1710 and mounting holes 1430. Similarly, curved weldment 1215 is attached to vertical support 1406. Curved weldment 1214 is attached to housing 1216 with mounting hardware through mounting holes 1718 in flange 1716 and mounting holes 1612 in flange 1610. Similarly, curved weldment 1215 is also attached to housing 1216.

Figure 18A:
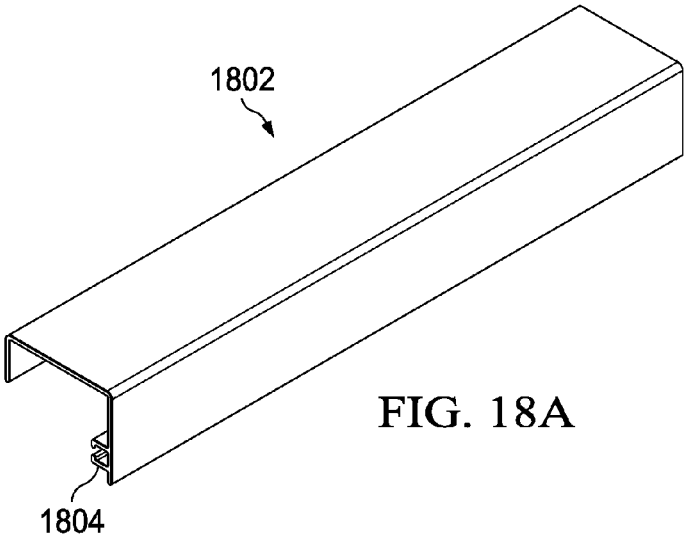
FIG. 18A is an isometric view of a top cover of the "L" shaped basket.

Referring to FIG. 18A top cover 1802 is an extruded piece having groove 1804 through its entire length. Groove 1804 is shaped to match grooves 1516, 1518, and 1520 of slat 1502. The opening to groove 1804 is constricted by ridges similar to the grooves of slat 1502. Top cover 1802 is attached to slatwall 1210 by sliding groove 1804 over the uppermost exposed nuts on vertical supports 1404 and 1406.

Figure 18B:
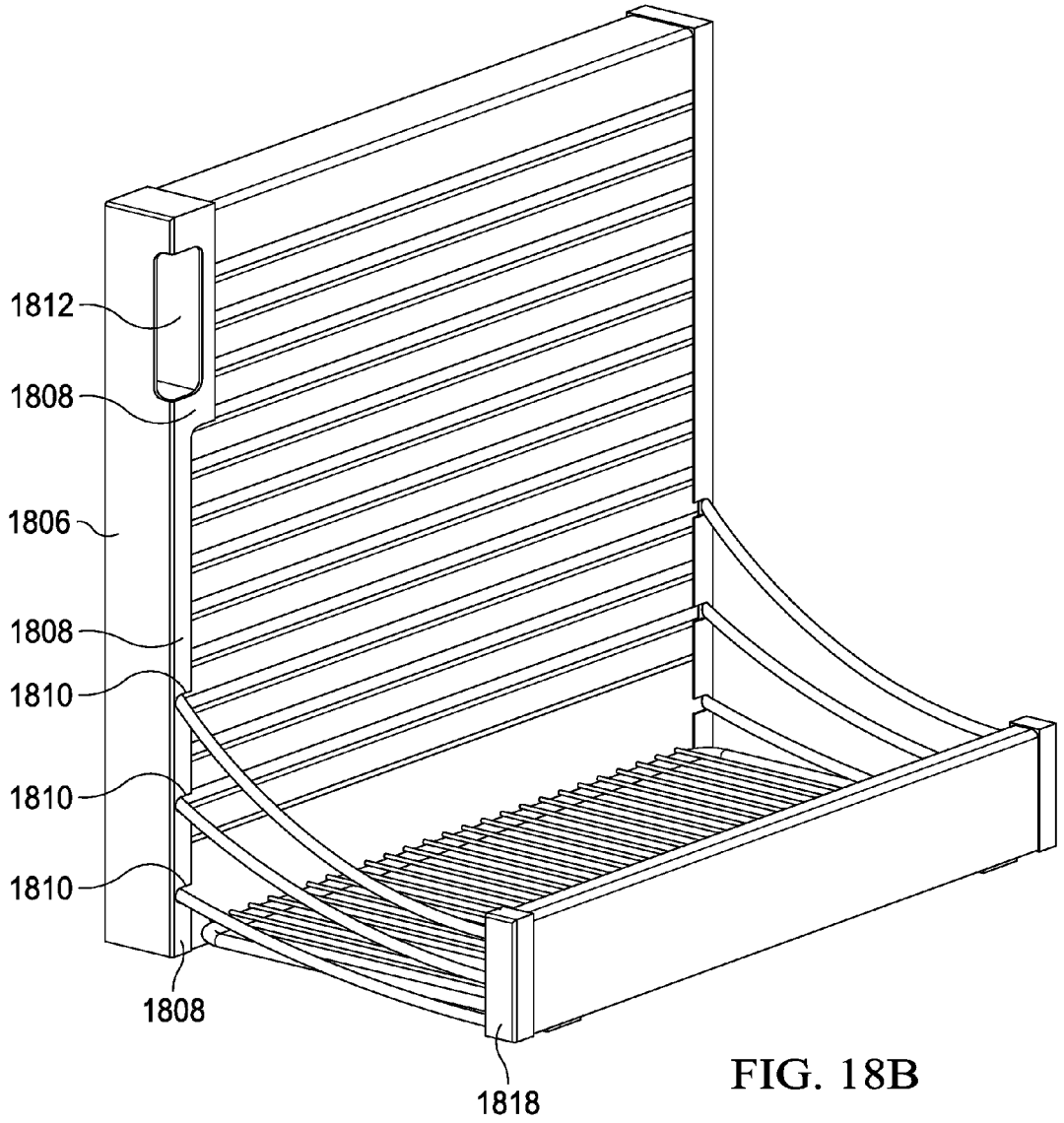
FIG. 18B is an isometric view of a pair of front covers attached to the "L" shaped basket frame.

As shown in FIG. 18B, front cover 1806 is generally rectangular and hollow. Front cover 1806 includes mounting holes 1808 and notches 1810. Front cover 1806 is attached to curved weldment 1214 via mounting hardware through mounting holes 1808 and mounting holes 1712. Notches 1810 are spaced and sized to accommodate braces 1705. Front cover 1806 further includes hand hole 1812. Hole 1812 is aligned with flange 1428 and provides a handle. Front cover 1818 is attached to curved weldment 1214 via mounting hardware through mounting holes (not shown) in front cover 1818 aligned with mounting holes 1720 in bracket 1704.

Figure 18C:
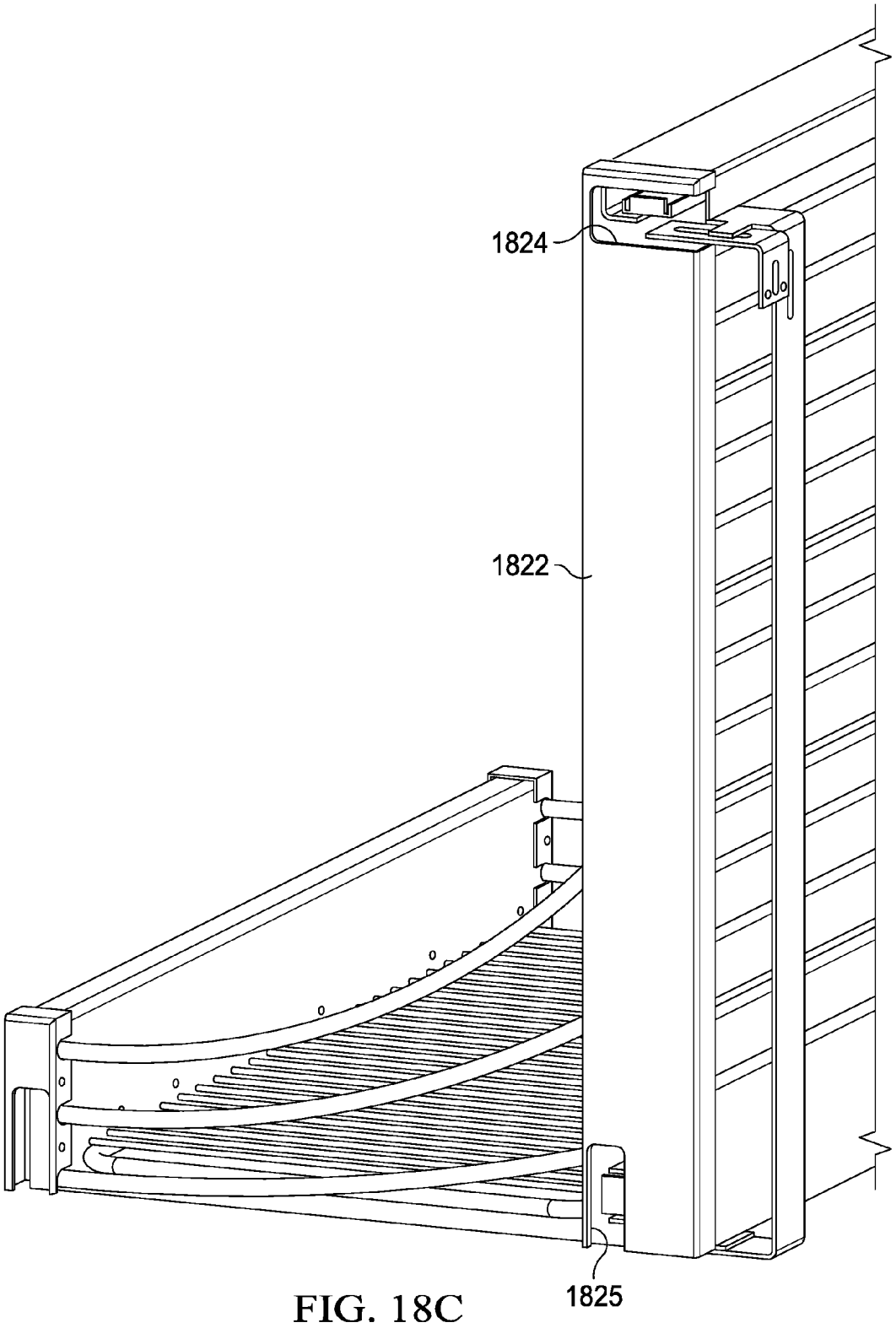
FIG. 18C is an isometric view of a pair of rear covers attached to the "L" shaped basket frame.

As shown in FIG. 18C, rear cover 1822 is attached to curved weldment 1215 and housing 1216 in the same manner as front cover 1806. Rear cover 1822 further includes cutouts 1824 and 1825 to allow passage of the drawer slides during use.

Figure 19:
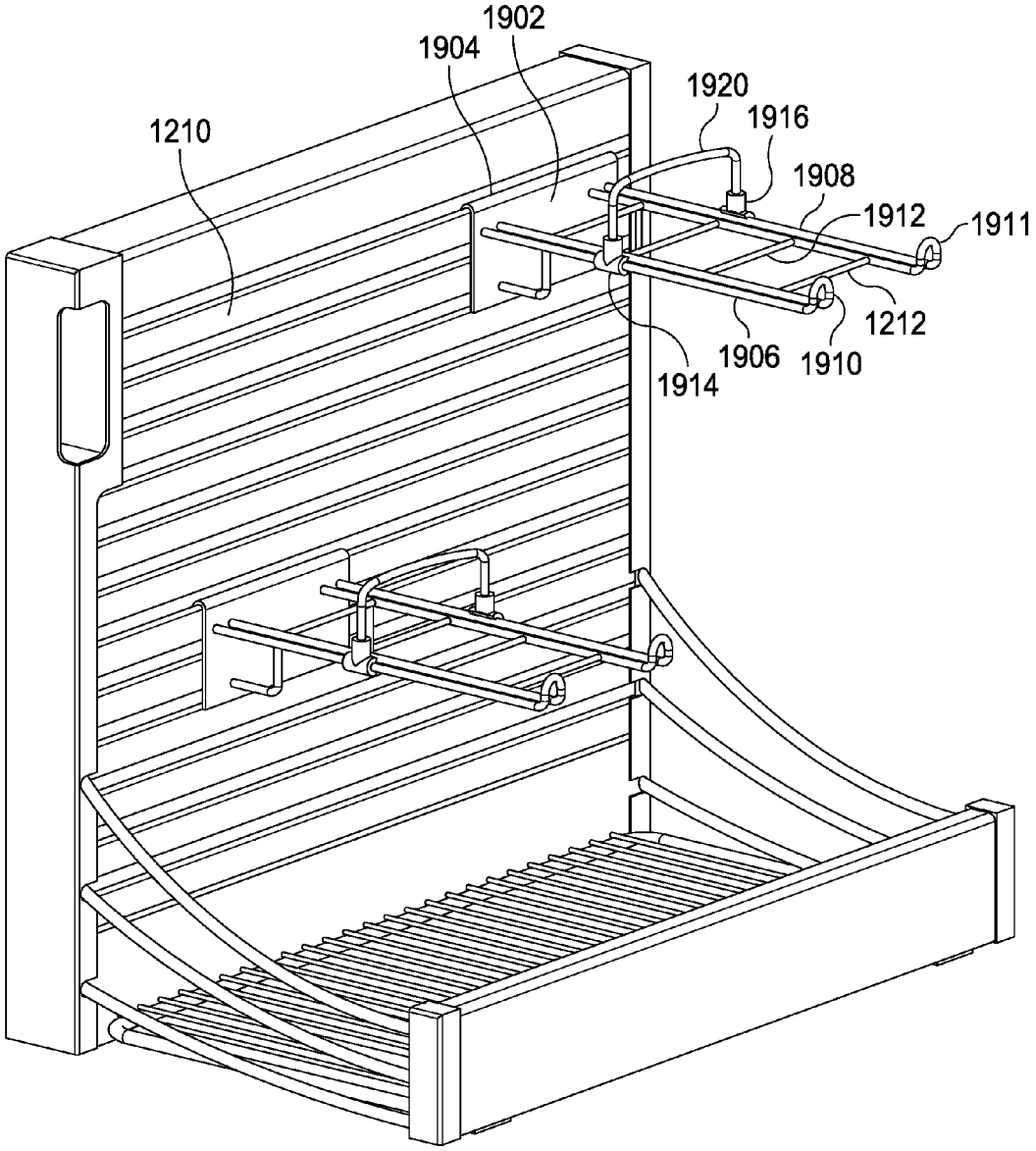
FIG. 19 is an isometric view of pot shelves attached to the slatwall of the "L" shaped basket.

Referring to FIG. 19, shelves 1212 are shown removably attached to slatwall 1210. Each shelf 1212 comprises base plate 1902 integrally formed with hooks 1904. Hooks 1904 engage hooks 1510, 1512, or 1514 in the slatwall. Shelves 1212 are repositionable along the slatwall. A pair of horizontal supports 1906 and 1908 extends from base plate 1902 and include wire shelf 1912 extending between them. Horizontal supports 1906 and 1908 terminate in upturned ends 1910 and 1911. Sleeves 1914 and 1916 are slidably attached to horizontal supports 1906 and 1908, respectively. Separator 1920 extends from sleeve 1914 to sleeve 1916. As a result, separator can slide the length of horizontal supports 1906 and 1908 in order to accommodate different sized pots and to secure the pots as the basket moves during use.

In use, "V" shaped basket 104 is slidably engaged with cabinet carcass 102 via slide assembly 220. "V" shaped basket 104 can be slidably moved between a stored position within the cabinet and a deployed position exterior to the cabinet. Hooks 702, 704, and 706 are removably and adjustably secured to slat 602 via the flanges on the hooks engaging groove 610. Bar 810 releasably clamps the hooks into place in the groove. Pots and pans are suspended from pins 718 and 728 extending from the hooks. Upturned ends 720 and 732 prevent pots from inadvertently sliding of the pins. Pins 712 and 726 on the hooks and adjacent hooks prevent the hanging pots from swaying and impacting each other as the basket moves during use. Lids to the hanging pots and pans as well as utensils, hot pads, etc. may be conveniently stored in pockets 445, 446, and 447.

"L" shaped basket 108 is slidably engaged with cabinet carcass 102 via slide assembly 1302. "L" shaped basket 108 can be slidably moved between a stored position within the cabinet and a deployed position exterior to the cabinet. Shelves 1212 are removably and adjustably secured to slatwall 1210 via hooks 1904 formed on base plate 1902. Hooks 1904 engage any of hooks 1510, 1512, and 1514 included on the plurality of slats 1502 that comprise slatwall 1210. Pots and pans are stored on shelves 1212 and wire shelf 1218. Shelves 1212 can be extended to accommodate larger pots and pans by sliding horizontal supports 1908 and 1909 along horizontal supports 1906 and 1907 away from slatwall 1210.

It will be appreciated by those skilled in the art that changes could be made to the embodiments described above without departing from the broad inventive concept. It is understood, therefore, that this disclosure is not limited to the particular embodiments herein, but it is intended to cover modifications within the spirit and scope of the present disclosure as defined by the appended claims.

The invention claimed is:

1. A kitchen organizer apparatus for slidable deployment from a cabinet comprising:

a slide assembly configured to be mounted to the cabinet;

a basket connected to the slide assembly;

a slat, having a first groove, connected to the basket;

a plurality of hooks removably engaged with the first groove;

wherein the apparatus is slidably movable between a stored position within the cabinet and a deployed position exterior to the cabinet;

a first support weldment, having a first bracket and a second bracket, attached to the basket; and, a first front cover attached to the first bracket and a second front cover attached to the second bracket.

2. The kitchen organizer of claim 1 further comprising:

a second support weldment attached to the basket; and, a rear cover attached to the second support weldment.

3. The kitchen organizer of claim 1 wherein the slat further comprises:

a second groove, wherein the slat is connected to the basket via the second groove; and, a set of ridges constricting an opening to the second groove.

4. The kitchen organizer of claim 1 wherein the slide assembly further comprises:

a brace, having a first end configured to be attached to the cabinet;

a rear bracket adjustably connected to the brace and configured to be attached to the cabinet;

a first U-bracket connected to the brace at the first end and a second U-bracket connected to the brace proximate the rear bracket;

a first inner rail connected to the first U-bracket and the second U-bracket;

a first outer rail, slidably engaged with the first inner rail, connected to the basket;

a second inner rail connected to the first U-bracket and the second U-bracket; and, a second outer rail, slidably engaged with the second inner rail, connected to the basket.

5. The kitchen organizer of claim 1 wherein the basket further comprises:

a plurality of separated and stepped pockets.

6. A kitchen organizer apparatus for slidable deployment from a cabinet comprising:

a slide assembly configured to be mounted to the cabinet;

a basket connected to the slide assembly;

a slat, having a first groove, connected to the basket;

a plurality of hooks removably engaged with the first groove; and, wherein the apparatus is slidably movable between a stored position within the cabinet and a deployed position exterior to the cabinet; and, wherein the basket further comprises a first pair of flanges spaced apart defining a first gap;

a second pair of flanges spaced apart defining a second gap;

wherein a first drawer slide assembly, housed in the first gap, is connected to the first pair of flanges and configured to be connected to the cabinet; and, wherein a second drawer slide assembly, housed in the second gap, is connected to the second pair of flanges and configured to be connected to the cabinet.

7. The kitchen organizer of claim 1 wherein the slat further comprises:

a first side opposite a second side;

the first groove formed in the first side and a second groove formed in the second side; and, wherein the slat is connected to the basket via the second groove.

8. The kitchen organizer of claim 1 further comprising:

a slanted surface defined in the first groove and adjacent the plurality of hooks.

9. A kitchen organizer apparatus for slidable deployment from a cabinet comprising:

a slide assembly configured to be mounted to the cabinet;

a basket connected to the slide assembly;

a slat, having a first groove, connected to the basket;

a plurality of hooks removably engaged with the first groove; and, wherein the apparatus is slidably movable between a stored position within the cabinet and a deployed position exterior to the cabinet;

a slanted surface, defined in the first groove, having a first angle; and, each hook of the plurality of hooks having a flange extending at the first angle and a pin extending perpendicularly.

10. A kitchen organizer apparatus for slidable deployment from a cabinet comprising:

a slide assembly configured to be mounted to the cabinet;

a basket connected to the slide assembly;

a slat, having a first groove, connected to the basket;

a plurality of hooks removably engaged with the first groove; and, wherein the apparatus is slidably movable between a stored position within the cabinet and a deployed position exterior to the cabinet; and, a clamp bar seated in the first groove adjacent the plurality of hooks.

11. The kitchen organizer of claim 1 further comprising:

a second slide assembly configured to be mounted to the cabinet;

a frame connected to the second slide assembly;

a platform connected to the frame;

a housing connected to the platform and to the second slide assembly;

a slatwall connected to the frame; and, a plurality of shelves removably attached to the slatwall.

12. The kitchen organizer of claim 11 further comprising:

a second support weldment attached to the frame and the housing; and, a third support weldment attached to the frame and the housing.

13. The kitchen organizer of claim 11 wherein the second slide assembly further comprises:

a first vertical support connected to a first horizontal support;

a second vertical support connected to a second horizontal support;

a first inner rail connected to the first vertical support and the second vertical support;

a first outer rail, slidably engaged with the first inner rail, connected to the frame;

a second inner rail connected to the first horizontal support and the second horizontal support;

a second outer rail, slidably engaged with the second inner rail, connected to the frame;

a third inner rail connected to the first horizontal support and the second horizontal support; and, a third outer rail, slidably engaged with the third inner rail, connected to the housing.

14. The kitchen organizer of claim 11 wherein the slatwall is comprised of a plurality of slats.

15. A kitchen organizer apparatus slidably engaged within a cabinet carcass comprising:

a brace configured to be mounted to the cabinet carcass;

a rear bracket adjustably engaged with the brace and configured to be mounted to the cabinet carcass;

a first drawer slide assembly connected to the brace and a basket;

a second drawer slide assembly connected to the brace and the basket;

a slat, having an integrally formed groove, connected to the basket with a series of nuts extending from the basket and engaging the groove;

a plurality of hooks adjustably engaged with the slat; and, wherein the apparatus is slidably movable between a stored position within the cabinet carcass to a deployed position outside of the cabinet carcass.

16. The kitchen organizer apparatus of claim 15 further comprising:

a first support weldment attached to the basket; and, a second support weldment attached to the basket.

17. The kitchen organizer apparatus of claim 15 further comprising:

a second slat connected to the basket; and, a second plurality of hooks adjustably engaged with the second slat.

18. A kitchen organizer for deployment from a cabinet carcass comprising:

a first slide assembly configured to be mounted to the cabinet carcass and connected to a "V" shaped wire basket;

the "V" shaped wire basket further comprising:

a wire basket frame connected to the first slide assembly and having a plurality of separated pockets;

a slat, having a first groove and a second groove, connected to the wire basket frame within the first groove; and, a plurality of hooks adjustably engaged with the second groove;

a second slide assembly configured to be mounted to the cabinet carcass and connected to an "L" shaped wire basket;

the "L" shaped wire basket further comprising:

a frame connected to the second slide assembly and connected to a wire shelf;

a housing connected to the second slide assembly and the wire shelf;

a slatwall, having third groove, connected to the frame via the third groove; and, a plurality of shelves adjustably connected to the slatwall; and, wherein the "V" shaped wire basket and the "L" shaped wire basket are individually movable between a stored position within the cabinet carcass and a deployed position exterior to the cabinet carcass.

* * * * *